United States Patent [19]

Chia et al.

[11] 4,234,359

[45] Nov. 18, 1980

[54] METHOD FOR MANUFACTURING AN ALUMINUM ALLOY ELECTRICAL CONDUCTOR

[75] Inventors: Enrique C. Chia; Roger J. Schoerner, both of Carroll County, Ga.

[73] Assignee: Southwire Company, Carrollton, Ga.

[21] Appl. No.: 870,651

[22] Filed: Jan. 19, 1978

Related U.S. Application Data

[60] Continuation-in-part of Ser. No. 632,982, Nov. 18, 1975, abandoned, which is a continuation-in-part of Ser. No. 430,300, Jan. 2, 1974, Pat. No. 3,920,411, which is a continuation of Ser. No. 199,729, Nov. 17, 1971, abandoned, which is a division of Ser. No. 54,563, Jul. 13, 1970, abandoned.

[51] Int. Cl.[3] ..... C22F 1/04

[52] U.S. Cl. ..... 148/2; 148/11.5 A

[58] Field of Search ..... 148/2, 11.5 A

[56] References Cited

U.S. PATENT DOCUMENTS

| | | | |
|---|---|---|---|
| 3,512,221 | 5/1970 | Schoerner | 148/2 |
| 3,920,411 | 11/1975 | Schoerner et al. | 148/2 |
| 4,000,008 | 12/1976 | Chia | 148/11.5 A |

*Primary Examiner*—R. Dean

*Attorney, Agent, or Firm*—Herbert M. Hanegan; Stanley L. Tate; Robert S. Linne

[57] ABSTRACT

This disclosure relates to a method and apparatus for manufacturing an aluminum alloy electrical conductor which promote the formation of a wire having a fine, stable subgrain structure of small cell size in the aluminum matrix and a fine dispersion of stable, insoluble intermetallic phase particles. The subgrain structure is improved by closely controlling the thermomechanical processing, particularly the casting rate, deformation parameters and annealing characteristics. After casting, the cast product is substantially immediately hot-formed in a rolling mill wherein the first deformation is more than 30% such that a substantially well defined subgrain structure will be formed in the aluminum matrix, thereby maximizing a refinement of the subgrain structure by permitting breaking-up thereof in each of the subsequent deformations in the rolling mill. After cold-working, without preliminary or intermediate anneals, the product is finally annealed at a temperature not exceeding approximately 700° F.

13 Claims, 29 Drawing Figures

Schematic Diagram of Production Process of Al-Fe-Co Alloy

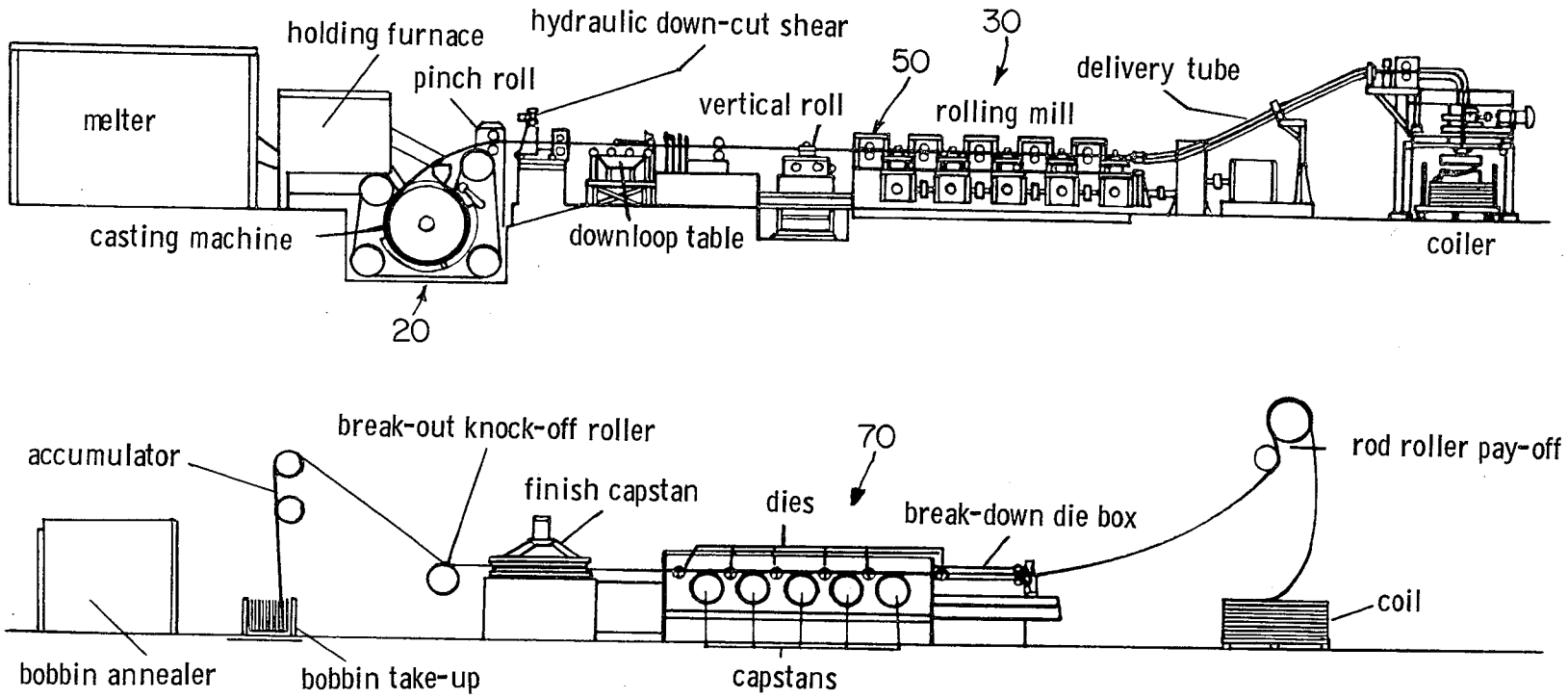
Fig. 1 Schematic Diagram of Production Process of Al-Fe-Co Alloy

Grain Structure of Al-Fe-Co Cast Bars
(a) Rapidly solidified and
(b) Slowly solidified Showing the Dendrite Arm Spacing. 800X Optical Photomicrograph of (a) Rapidly Solidified Sample and (b) the Slow Solidified Sample Taken in the Transverse Direction of the 0.375 Inch Hot-Rolled Rods of Al-Fe-Co Alloy. 800X Optical Photomicrographs of Al-Fe-Co Alloy and EC Aluminum Annealed Wire Produced From (a) Rapidly Solidified Bar and (b) Slowly Solidified Bar in the Cross Sectional Direction. (800X) Showing Particle Distribution.

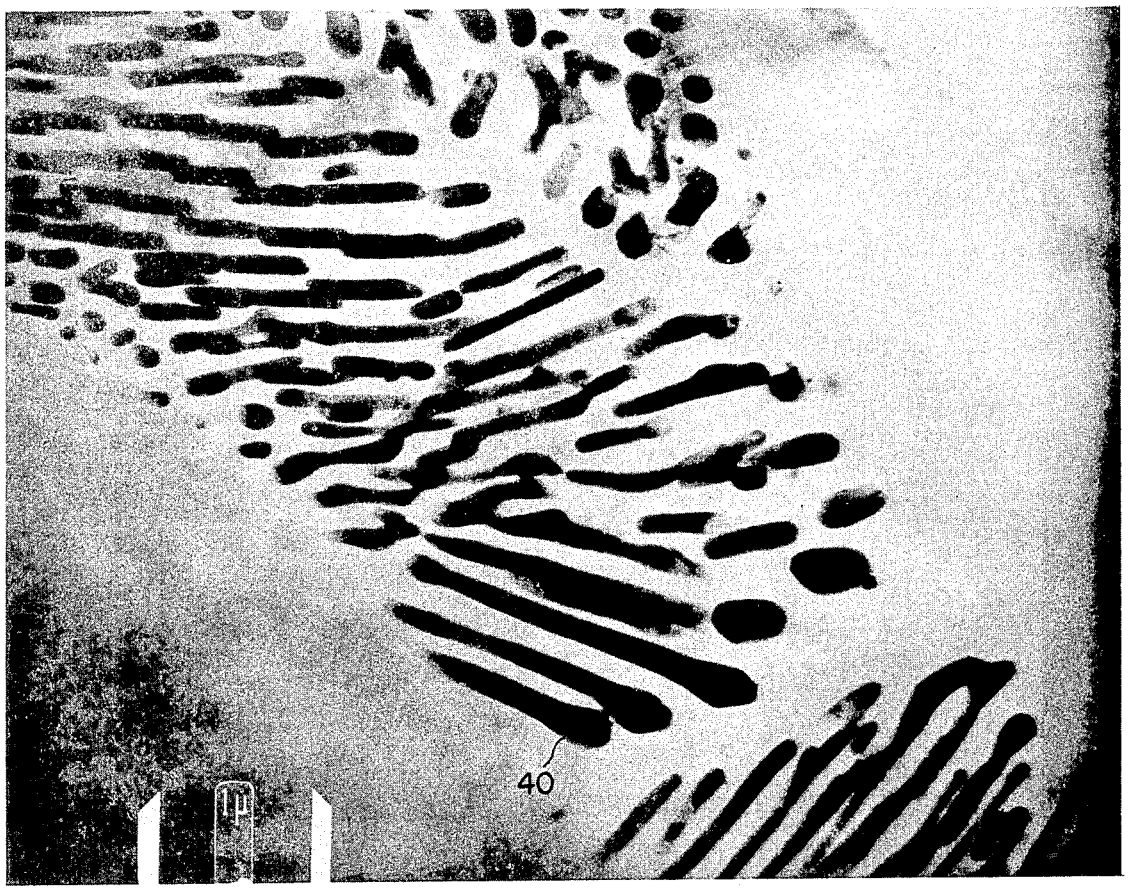
Fig. 5 TEM of a Al-Fe-Co Cast Bar Sample, Showing Colony of (Fe Co) $Al_9$ and Fe $Al_6$ Eutectic in the Aluminum Matrix.

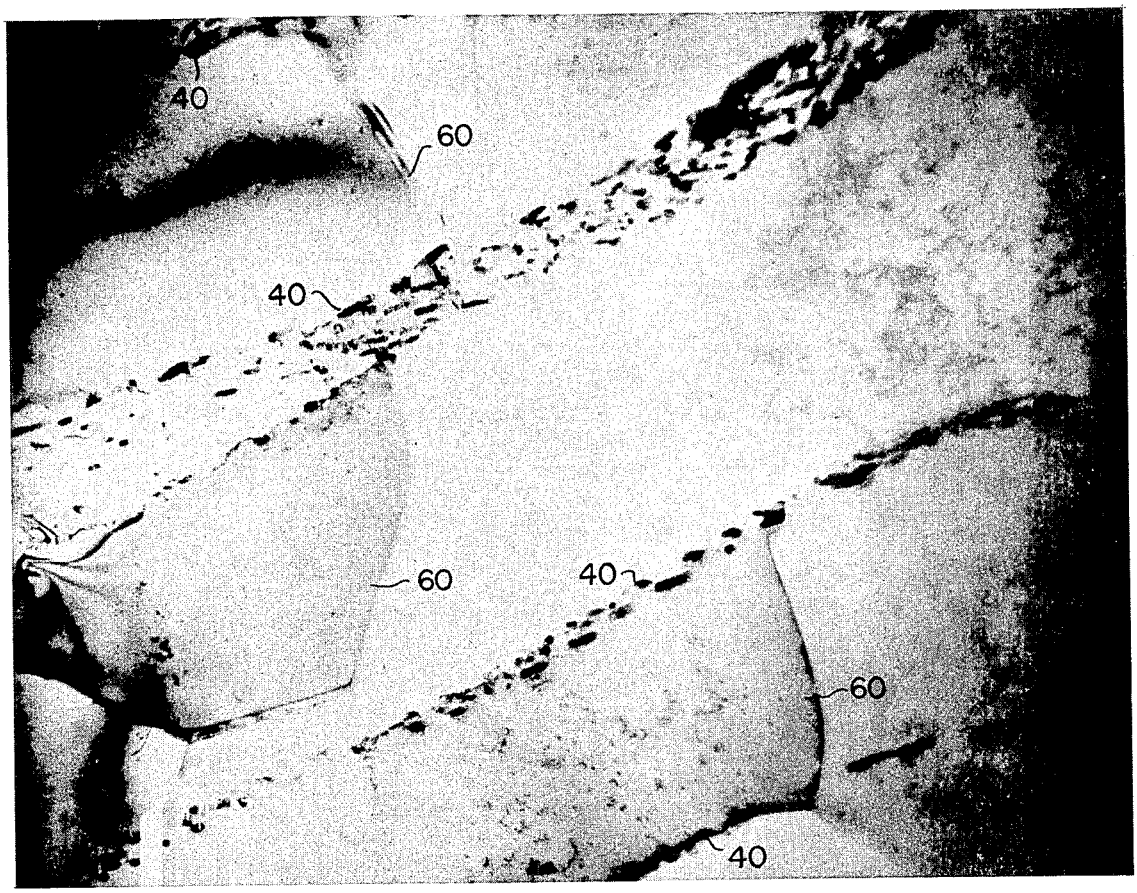
Fig. 6 TEM of the Al-Fe-Co Microstructure After the First Pass (37.3 per cent Reduction in Area), Showing the Onset of Subgrain Formation During Hot Rolling. The Subgrains form Initially Between Rows of Eutectic.

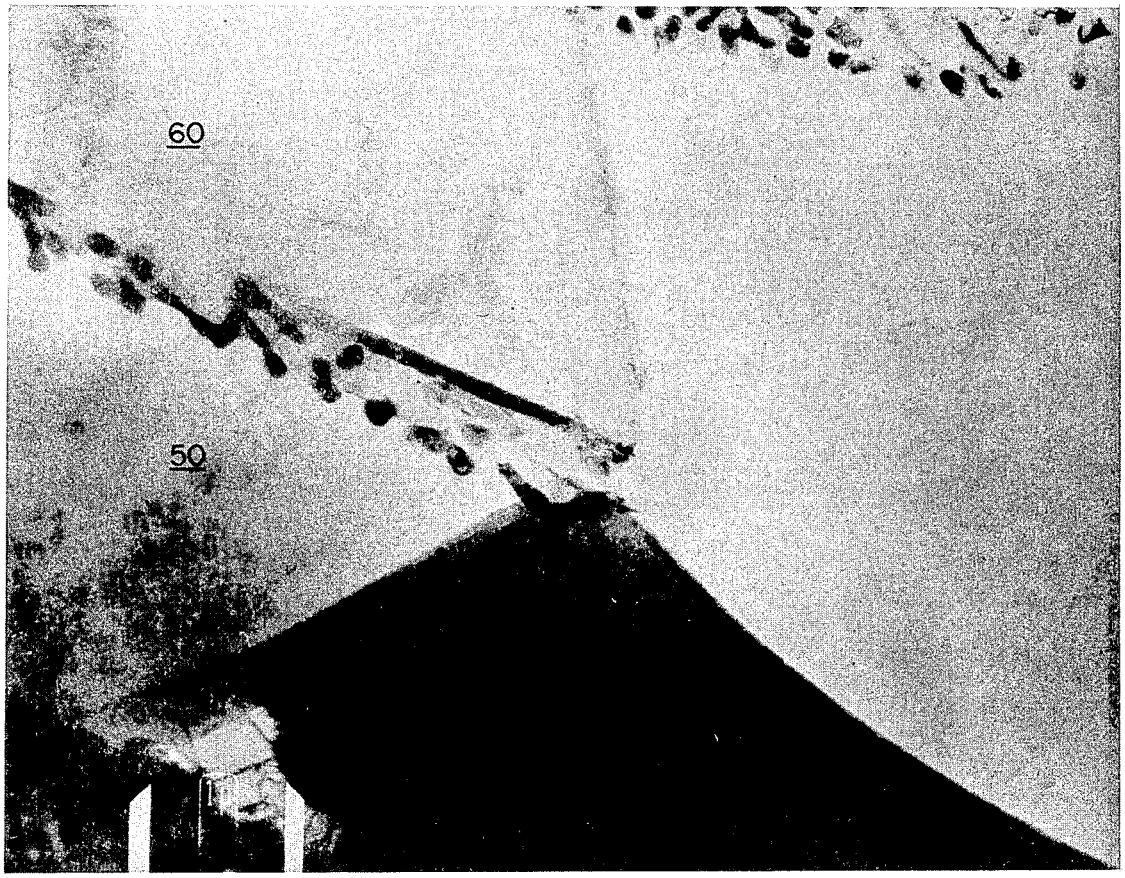
Fig. 7 TEM of the Al-Fe-Co Microstructure After the First Pass (37.3 Percent Reduction in Area), Showing the Effect of the Precipitates on the Formation of the Cells.

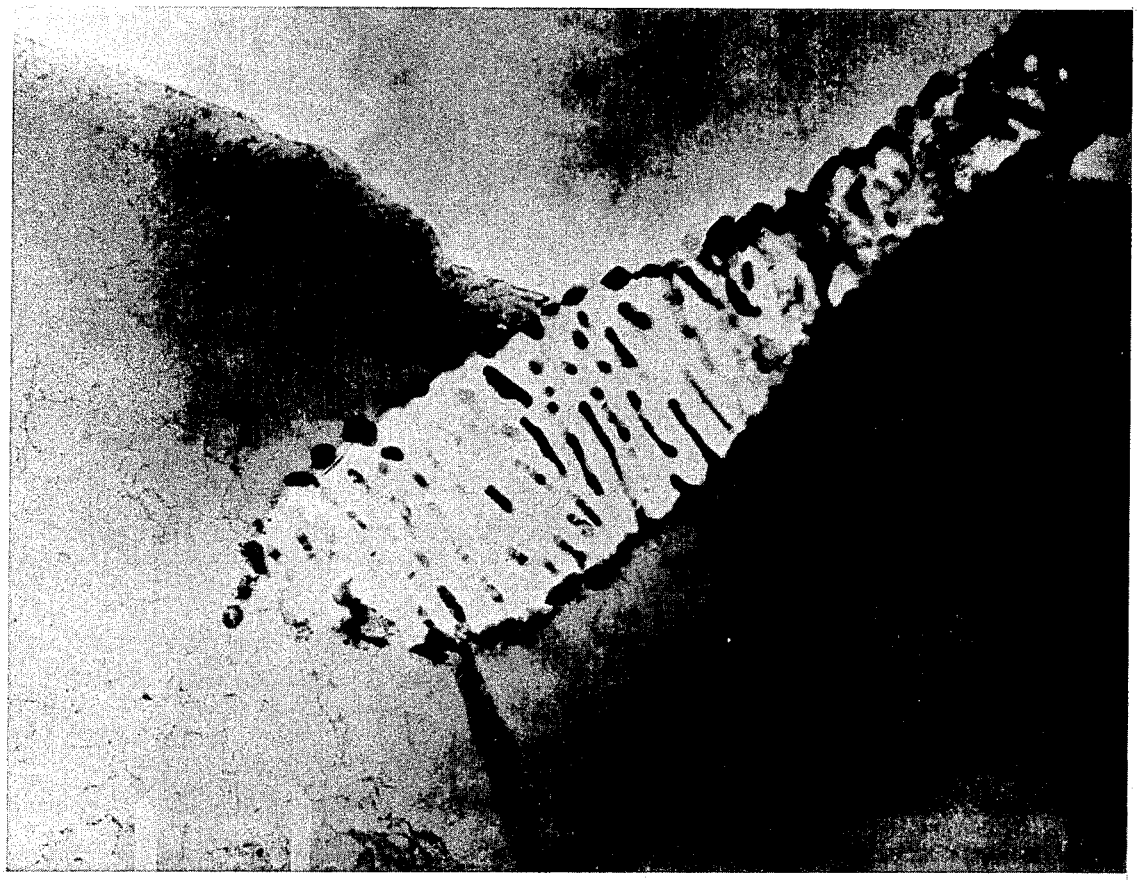
Fig. 8 TEM of the Al-Fe-Co Microstructure After the First Pass, Showing Dislocations Forming Cells in the Vicinity of Precipitates.

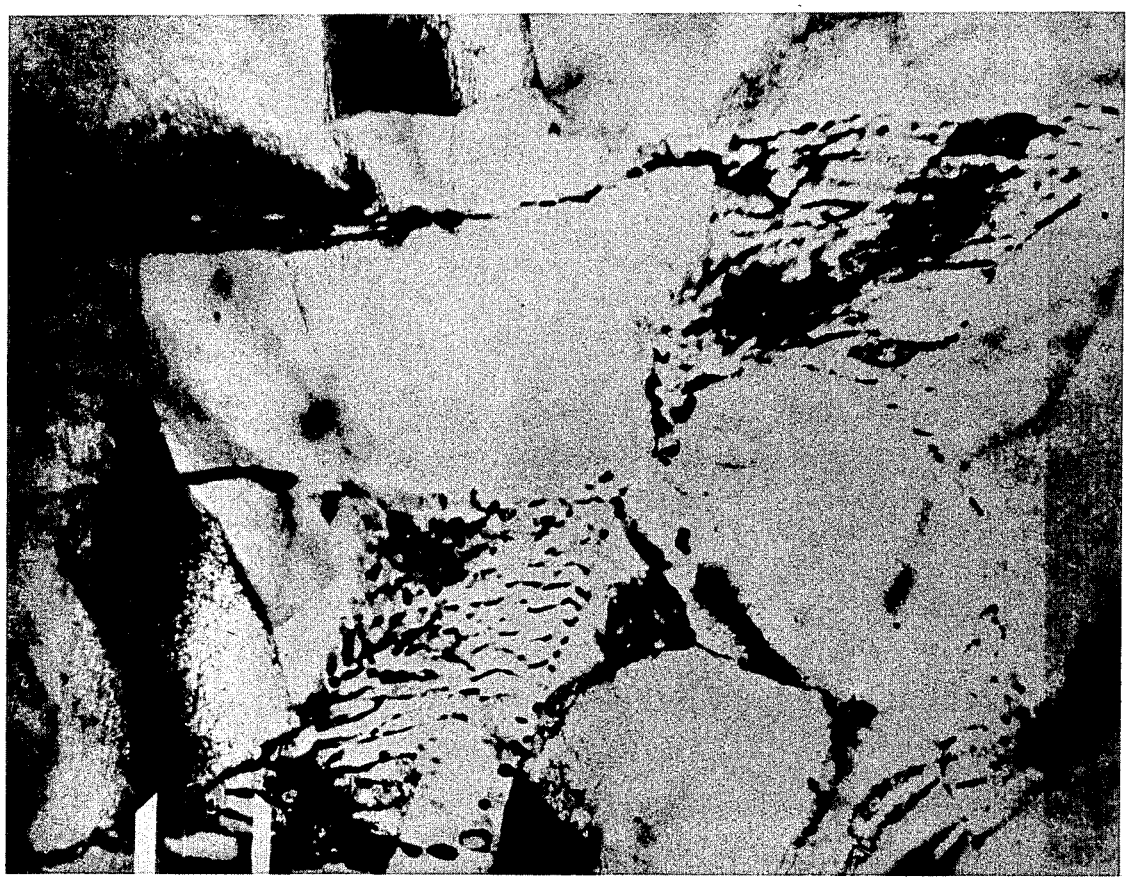
Fig. 9 TEM of the Al-Fe-Co Microstructure After the Second Pass (59.2 Percent Reduction).

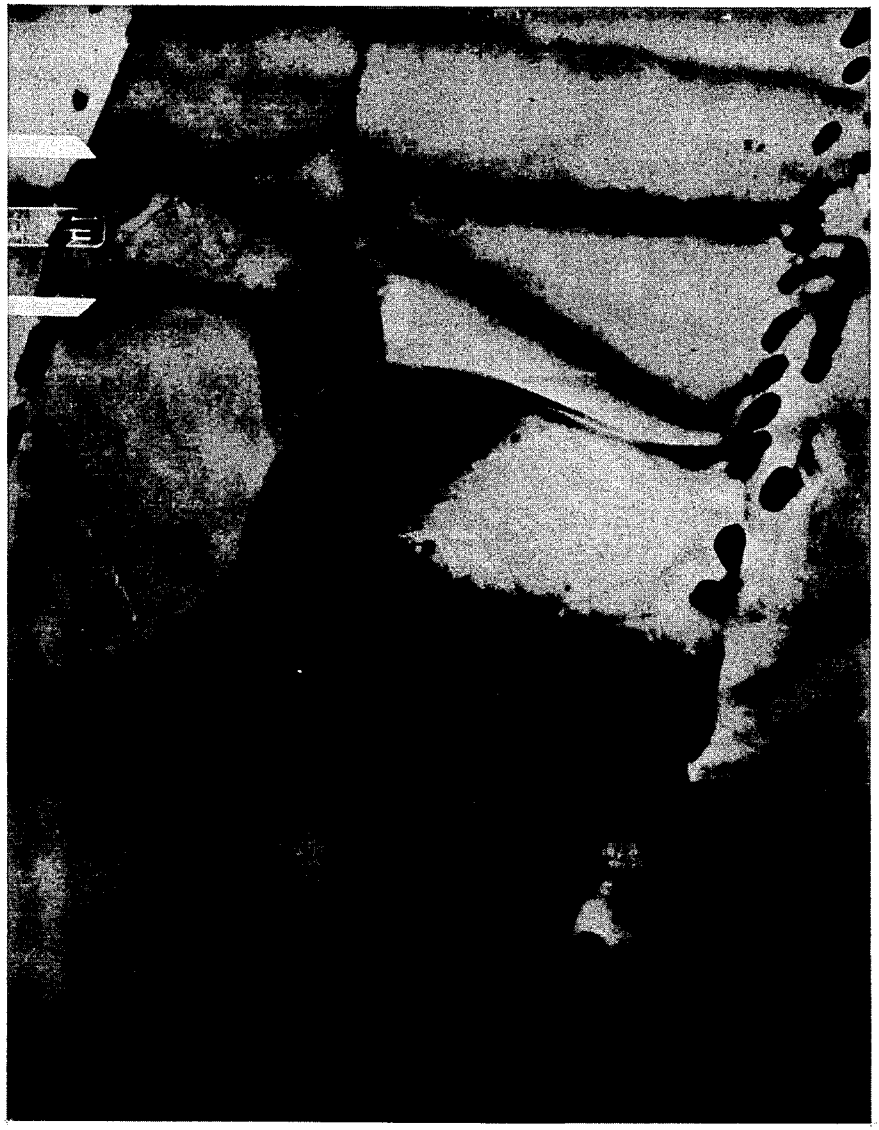
Fig. 10 TEM of the Al-Fe-Co Microstructure After the Third Pass (69.2 Percent Reduction), Showing Further Cell Formation During Hot Rolling. Notice Refinement of the Cells Even in Areas Devoid of Precipitates.

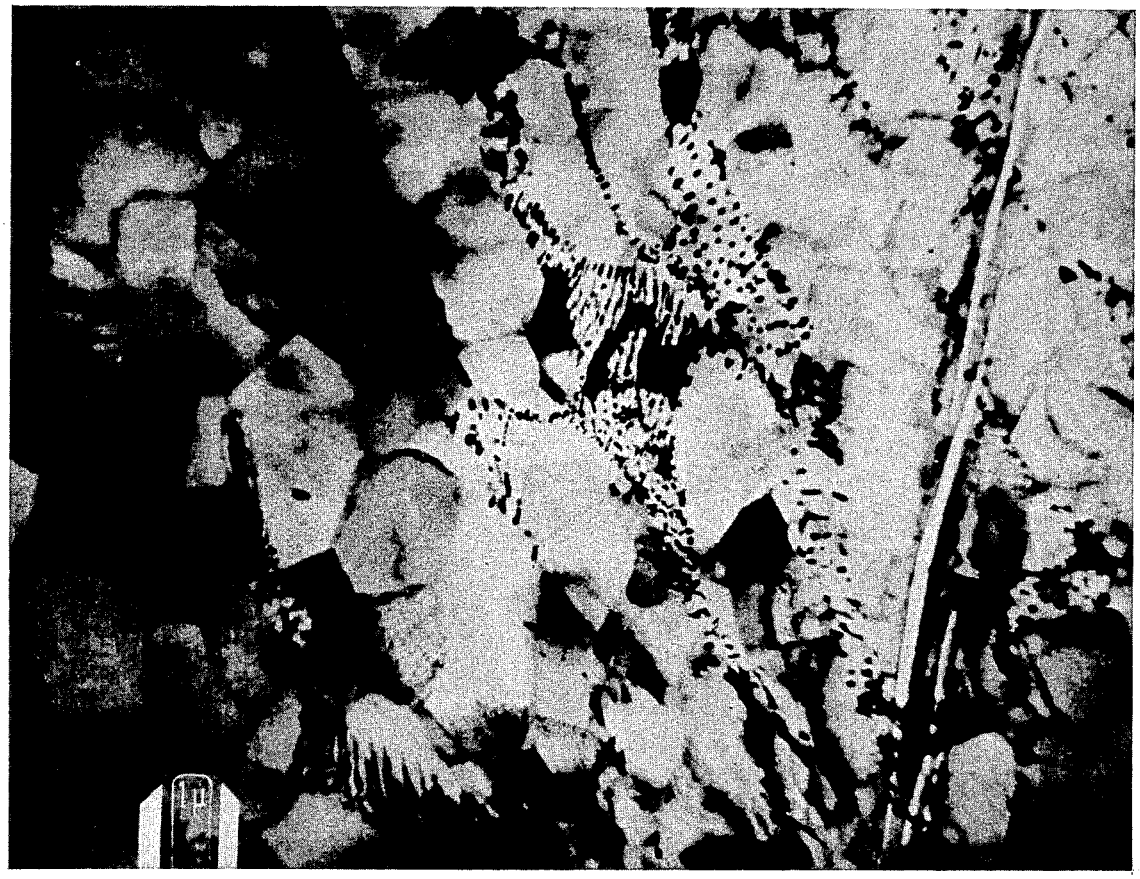
Fig. 11 TEM of the Al-Fe-Co Microstructure After the Fourth Pass (78.1 Percent Reduction), Showing Eutectic Colonies Surrounded by Cells.

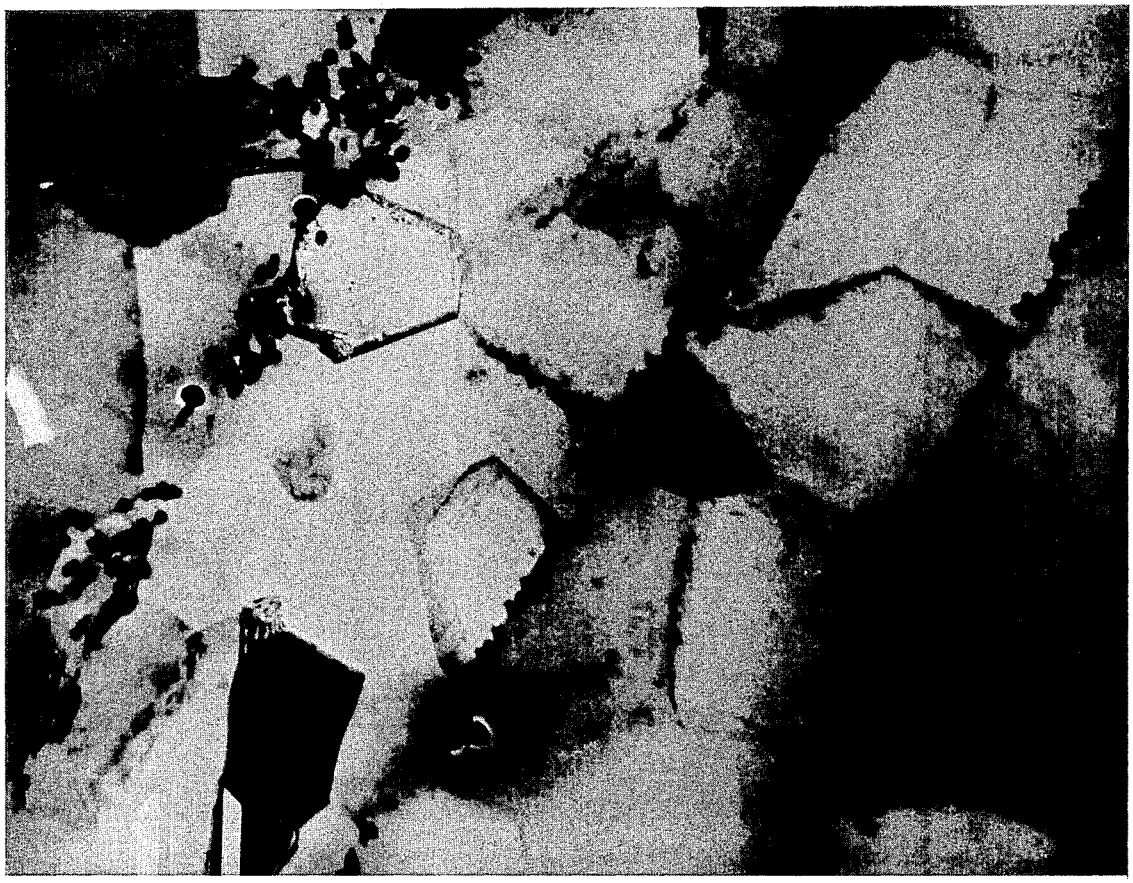
Fig. 12 TEM of the Al-Fe-Co Microstructure After the Sixth Pass (88.4 Percent Reduction). A Higher Degree of Cell Uniformity is Present in this Specimen.

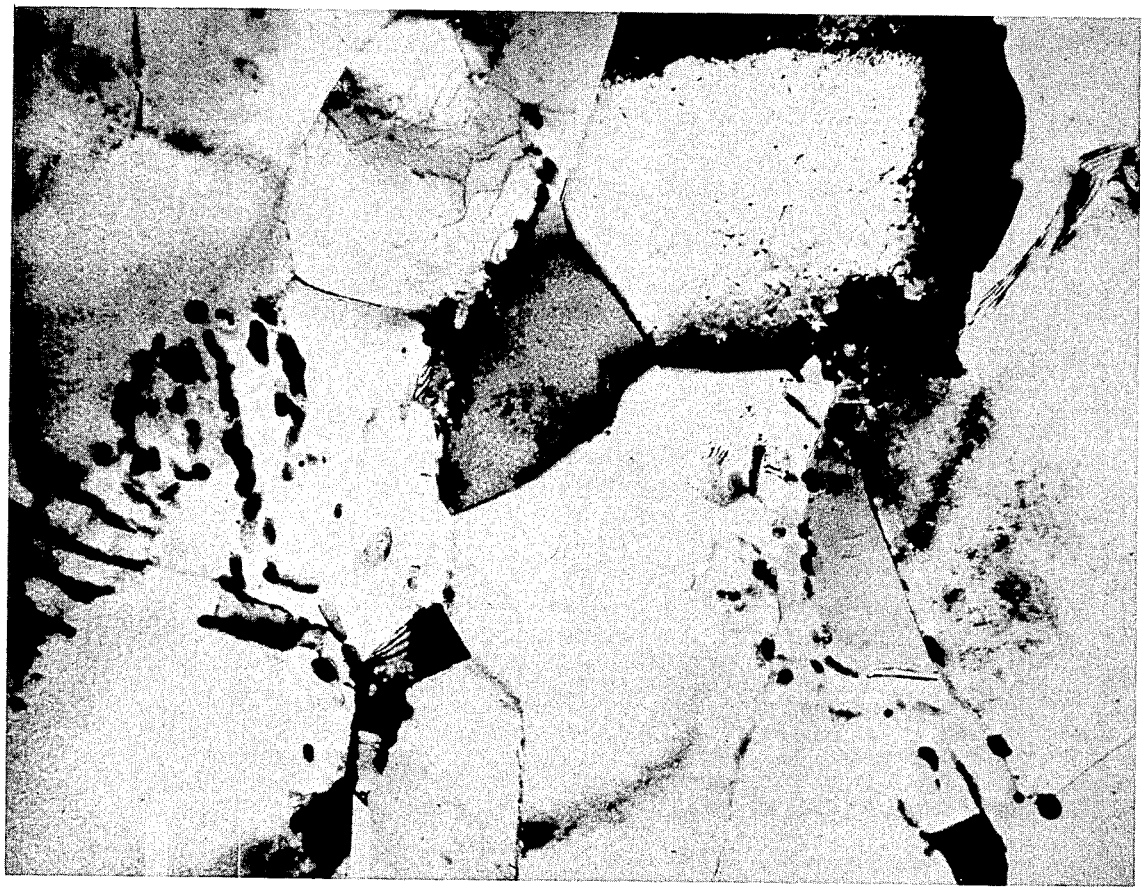
Fig. 13 TEM of the Al-Fe-Co Microstructure After the Seventh Pass (91.3 Percent Reduction), Showing Increasing Dislocation Density Within the Cells Due to a Decrease in Dynamic Recovery at this Stage.

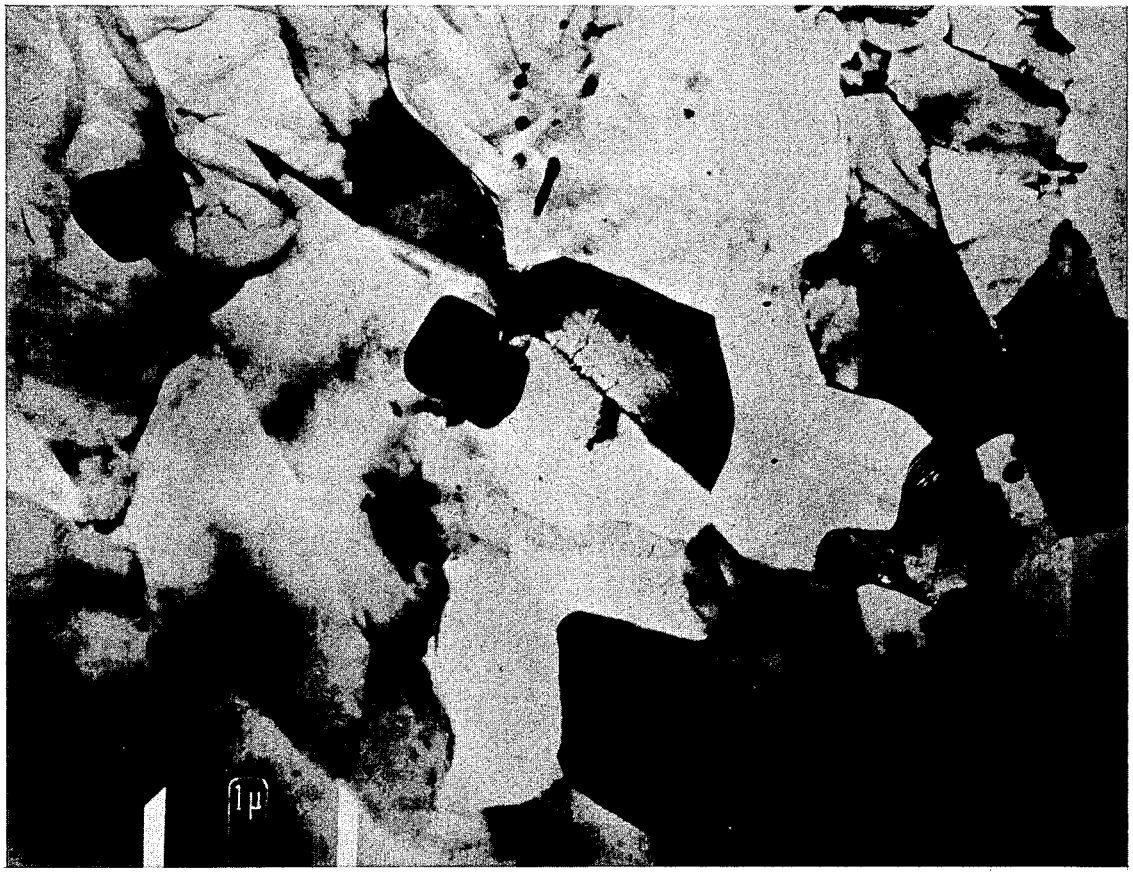
Fig. 14 TEM of the Al-Fe-Co Microstructure After the Eighth Pass (94.0) Percent Reduction).

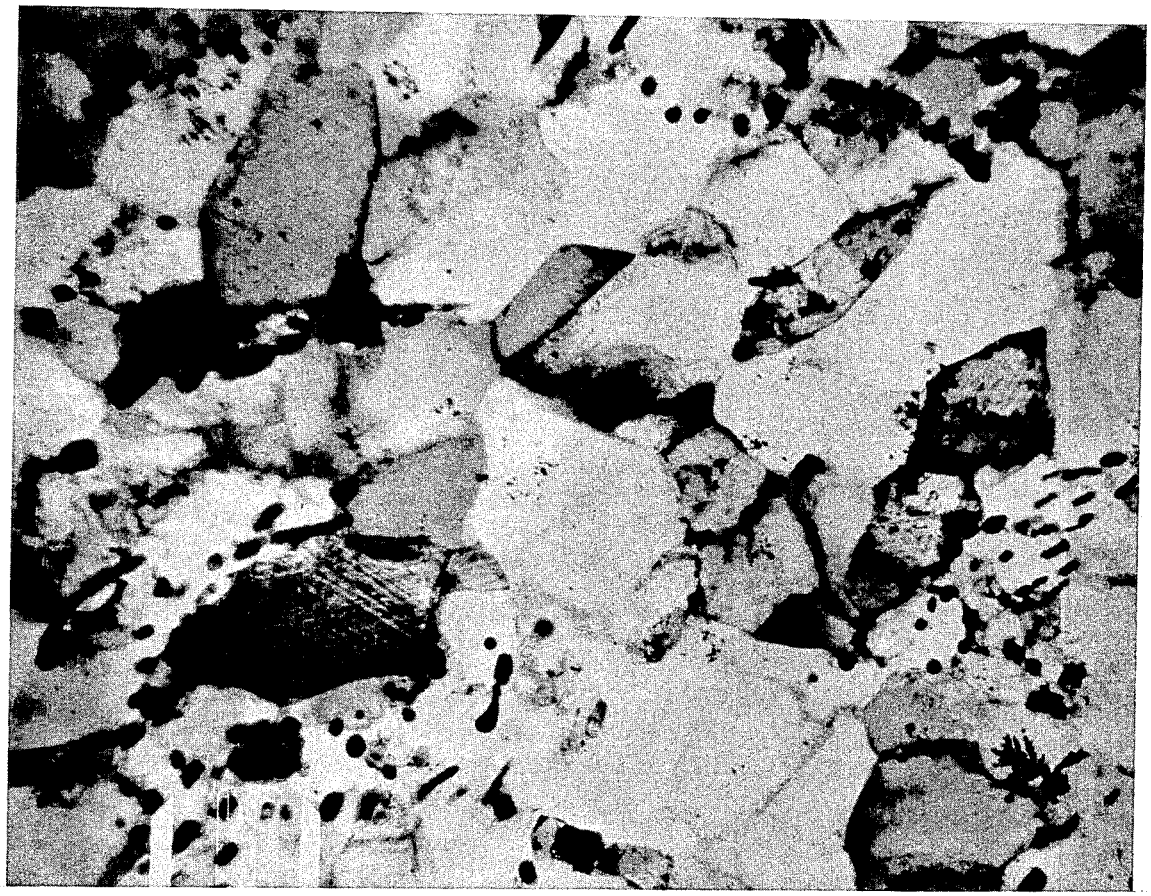
Fig. 15 TEM of the Al-Fe-Co Microstructure after the Ninth Pass (95.5 Percent Reduction), Showing an Increasing Dislocation Density and a Significant Decrease in Cell Size.

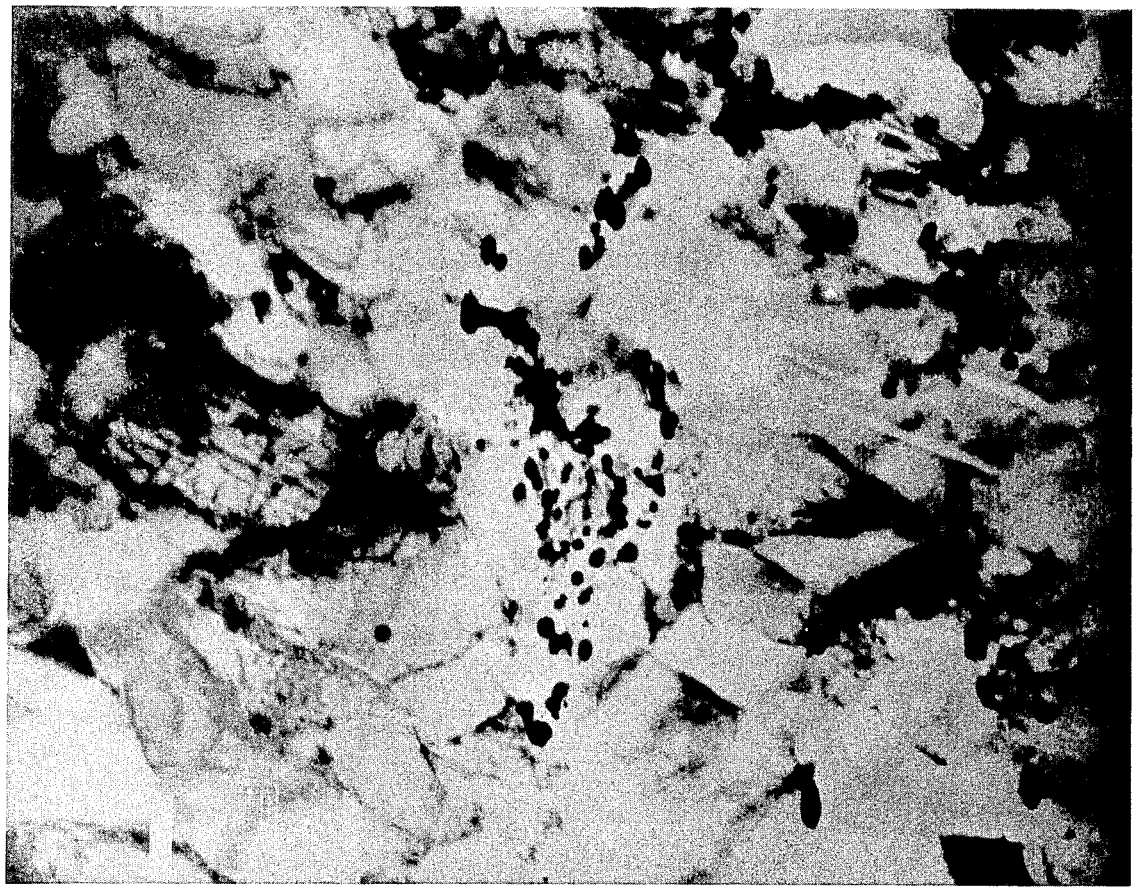
Fig. 16 TEM of the Al-Fe-Co Microstructure after the Tenth Pass (96.8 Percent Reduction), and Showing Continuing Refinement of the Cell Size and Increasing Number of Dislocation Tangles.

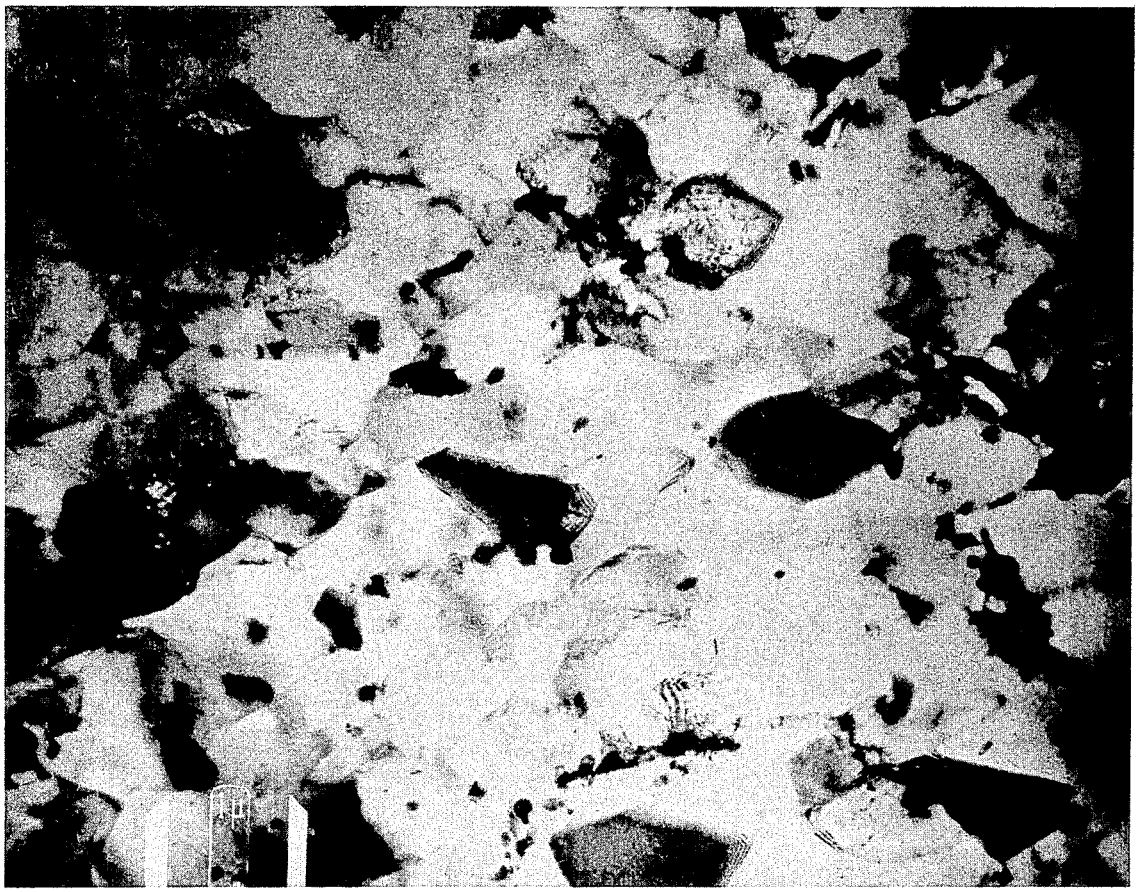
Fig. 17 TEM of the Al-Fe-Co Microstructure after the Eleventh Pass (97.7 Percent Reduction), Showing a High Dislocation Density.

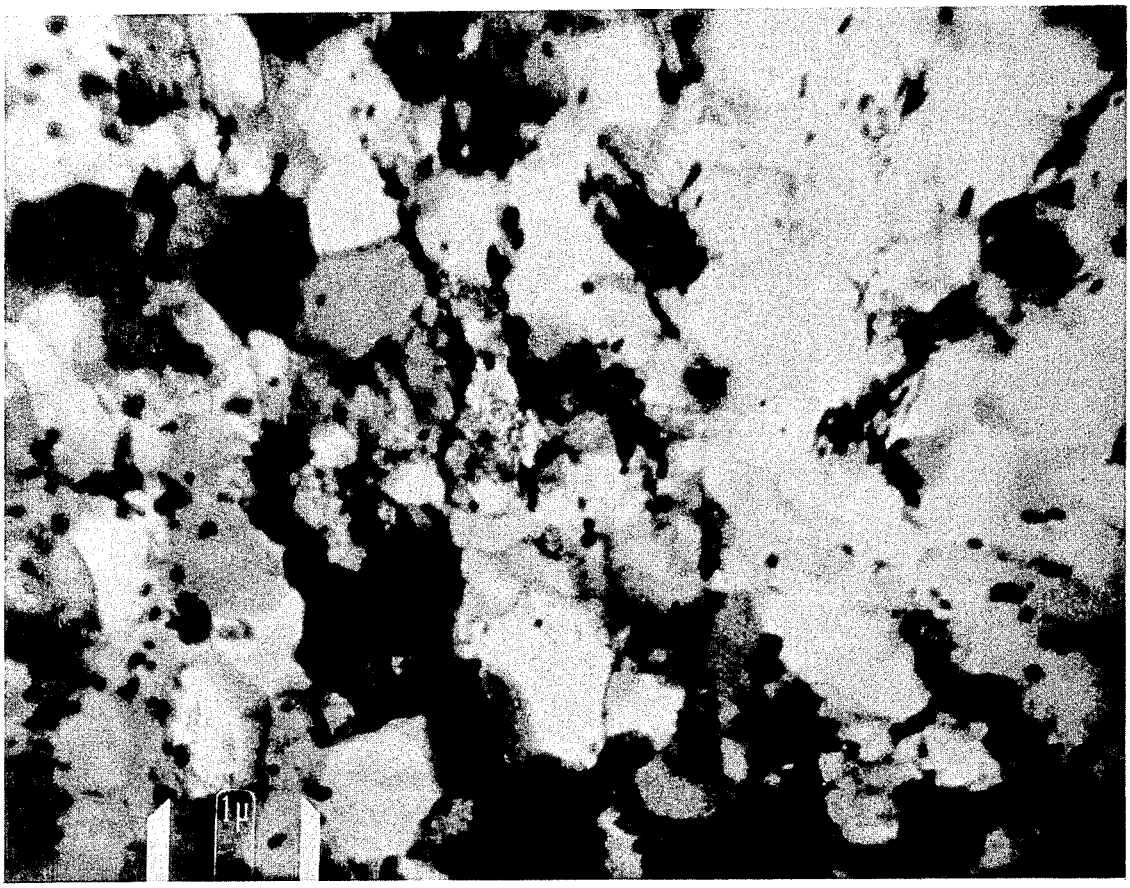
Fig. 18 TEM of the Al-Fe-Co Microstructure after the Twelfth Pass (98.2 Percent Reduction).

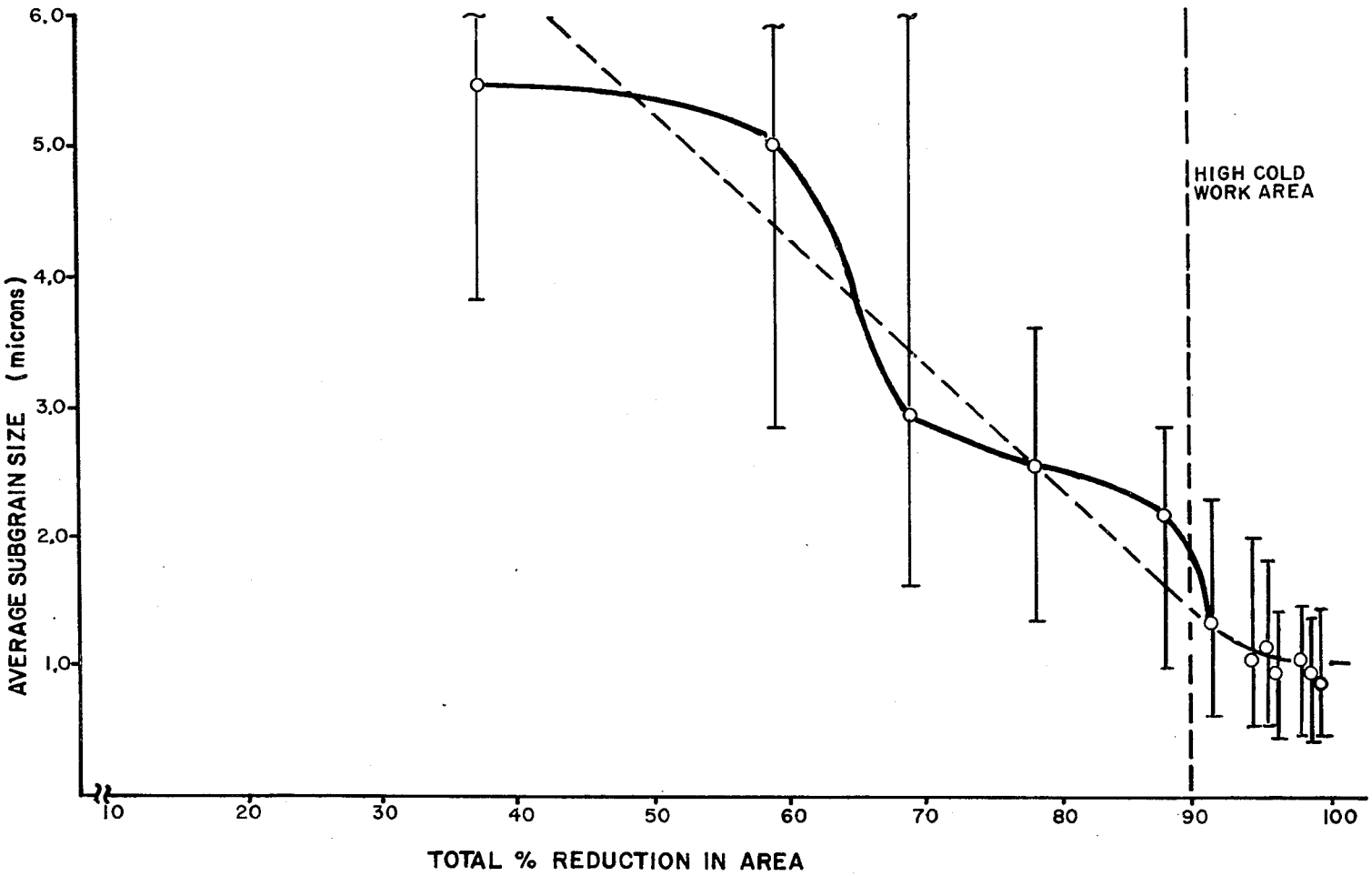
Fig. 19 Decrease in Subgrain Size During Hot Rolling Al-Fe-Co Alloy.

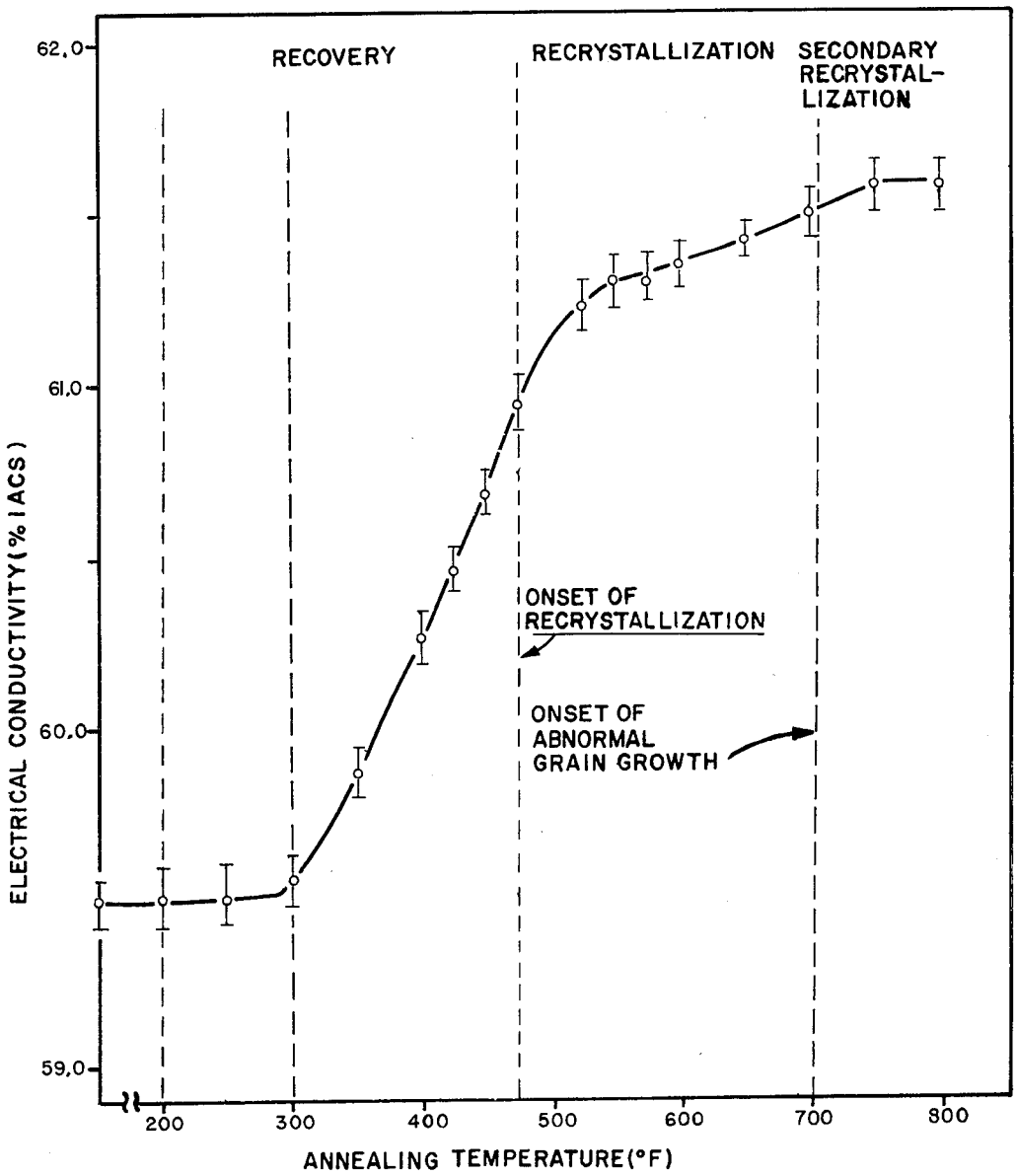
Fig. 20 Effect of Isochronal One-Hour Annealing on Electrical Conductivity of 0.105 Inch Diameter Al-Fe-Co Alloy Wire.

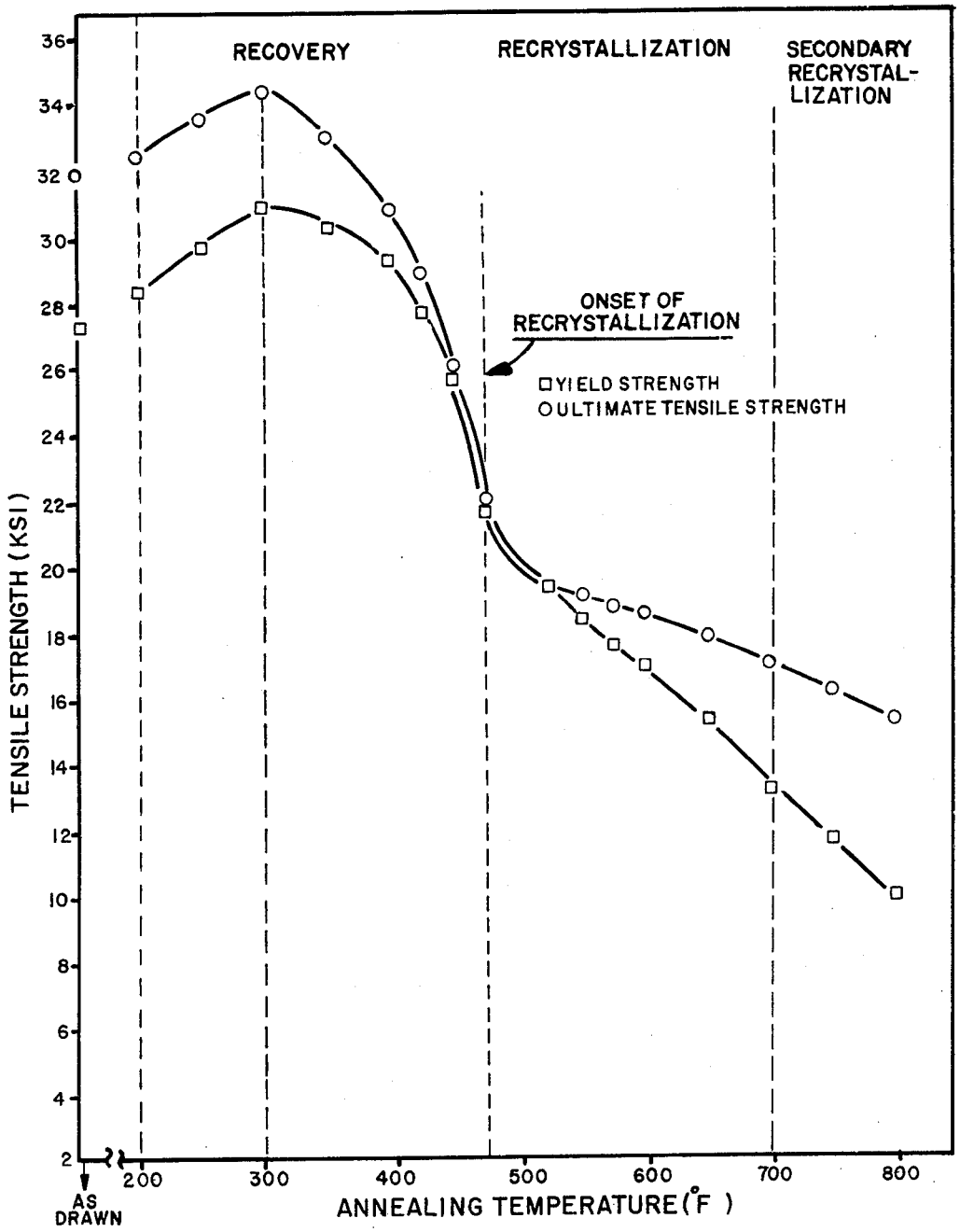
Fig. 21 Effect of Isochronal One-Hour Annealing on Ultimate Tensile Strength of 0.105 Inch Diameter Al-Fe-Co Alloy Wire.

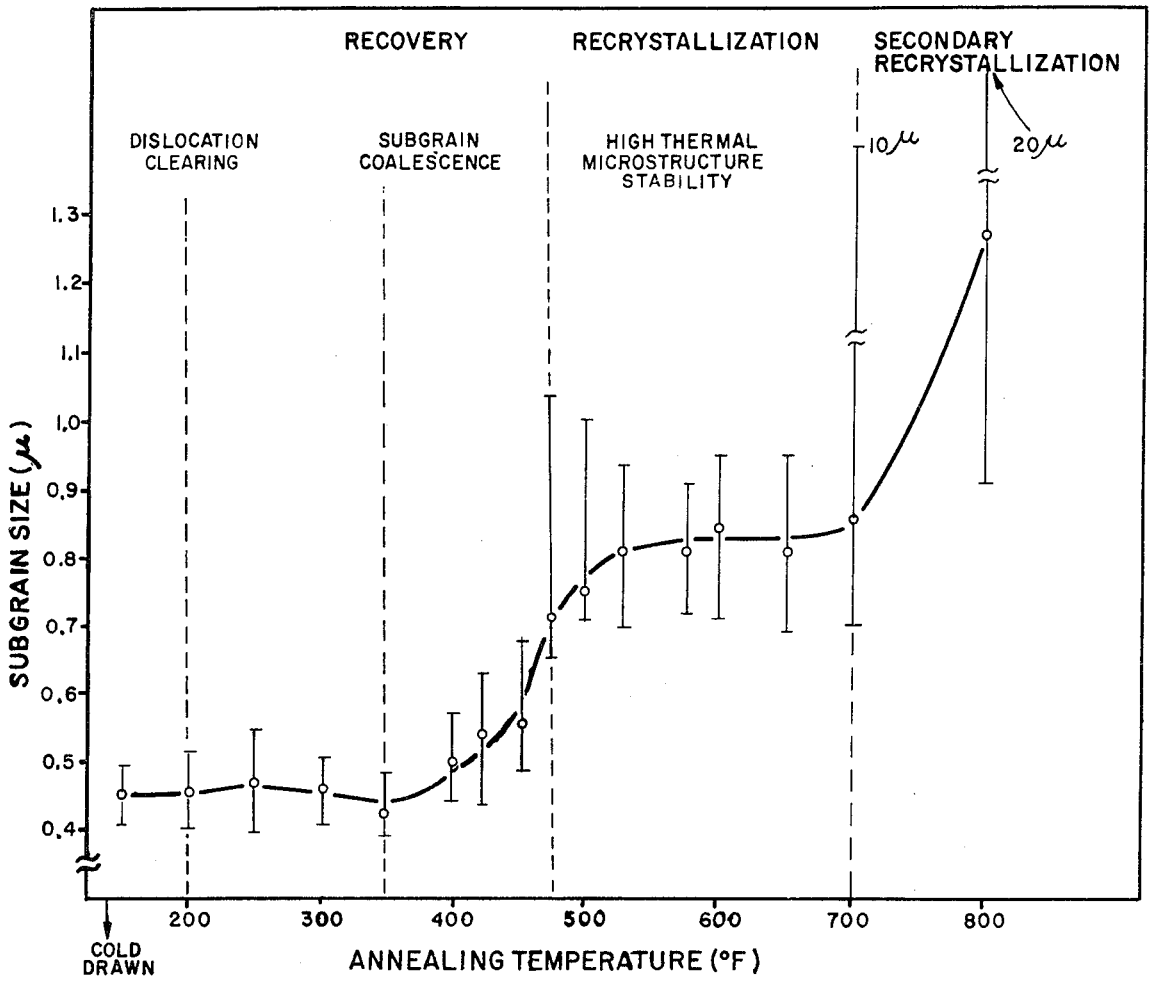
Fig. 22 The Effect of Isochronal (one hour) Annealing on the Subgrain Size in 0.105 Inch Al-Fe-Co Wire. The Error Bars Represent the Range in Size due to the Statistical Standard Deviation in the Individual Measurements.

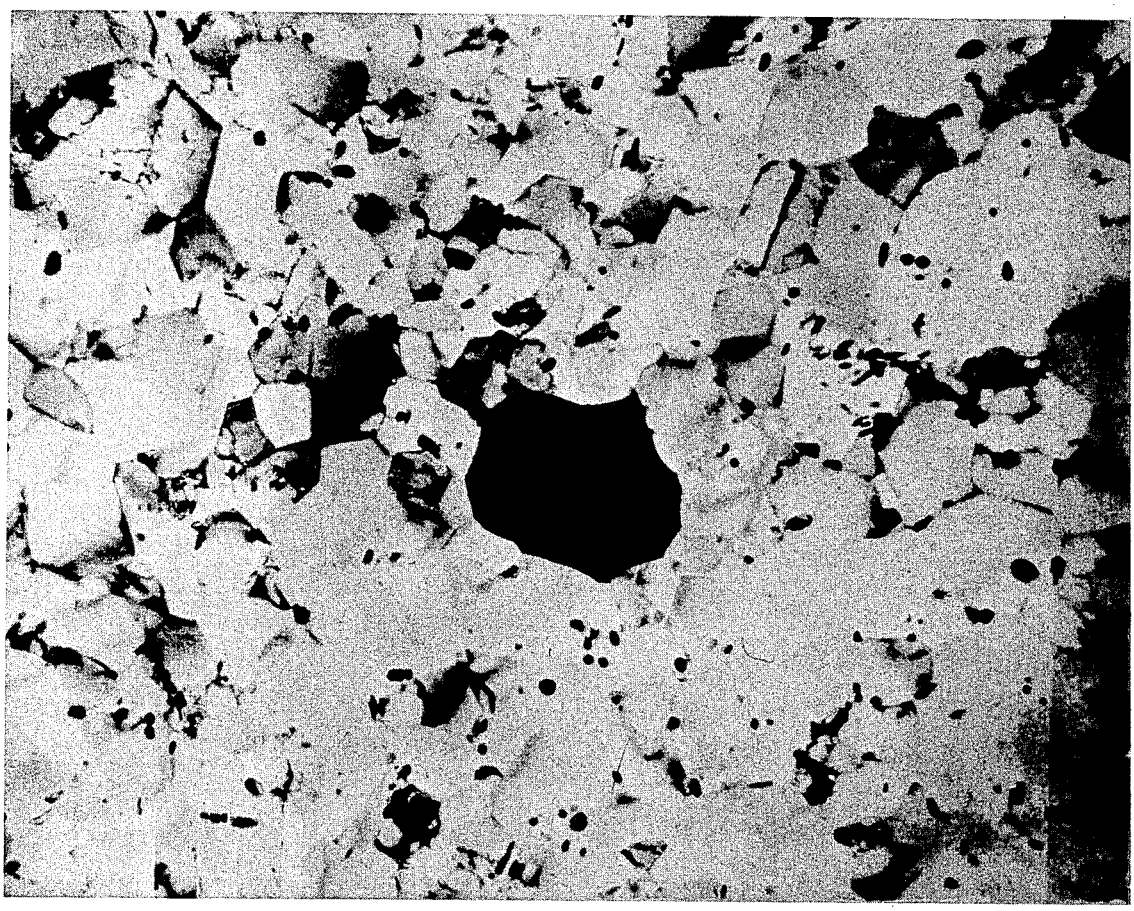
Fig. 23 TEM of Al-Fe-Co Alloy Wire Annealed at 475°F for one hour Showing a Growing Recrystallization Nucleus. The High Degree of Misorientation Between the Nucleus and the Adjacent Subgrains can be Judged by the Relative Difference in Darkness.

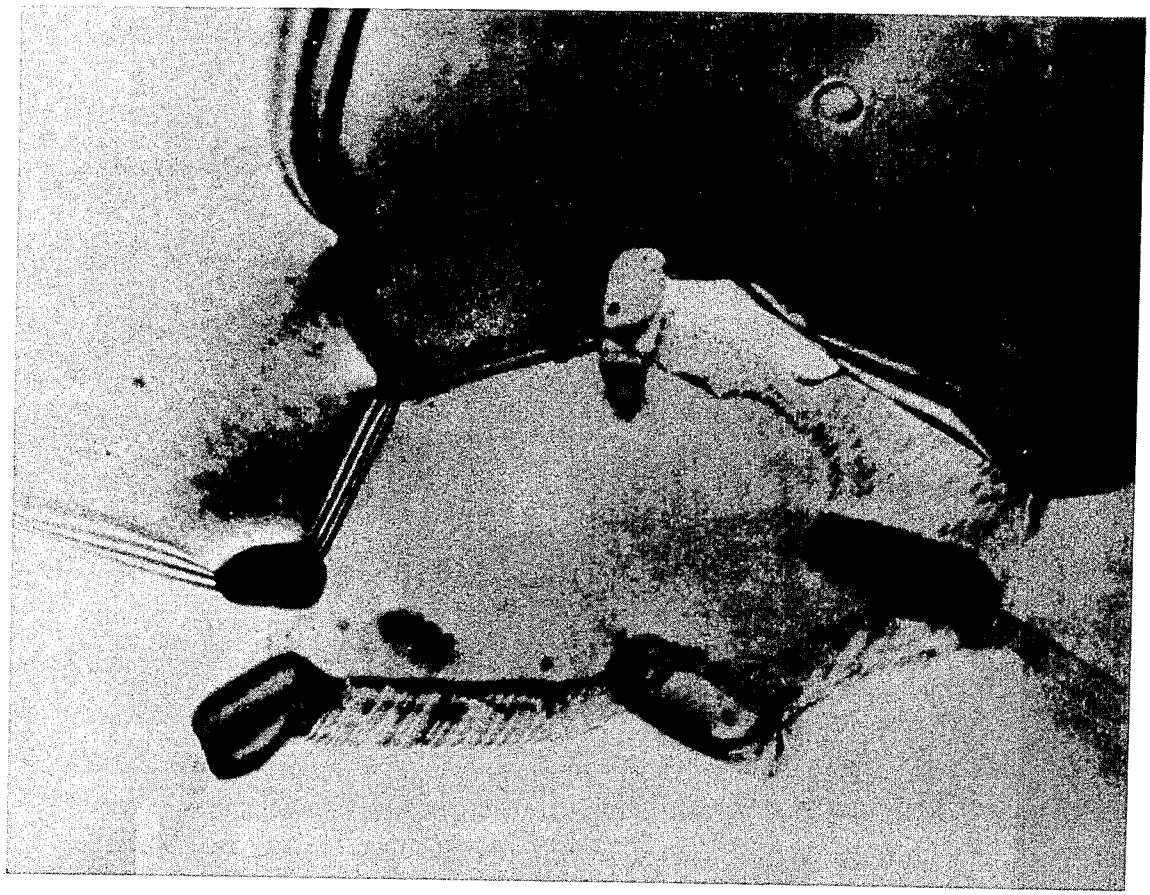
Fig. 24 TEM of Al-Fe-Co Alloy Wire Isochronally Annealed at 500°F for 1 hour showing that the Interparticle Spacing has Become of the Same Magnitude as the Subgrain Size. This is Due to the Obstruction of Subgrain Coalescence by the Pinning Effect of the Particles.

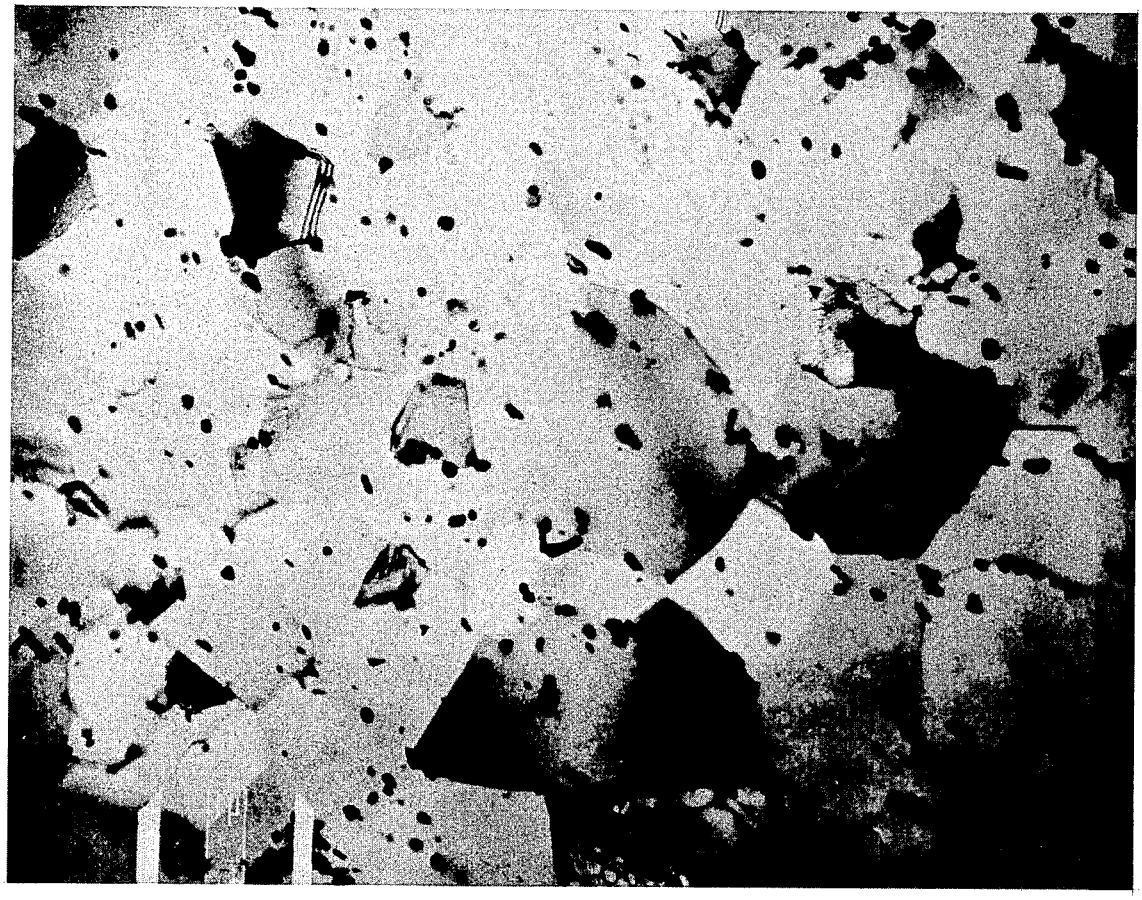
Fig. 25 TEM of Al-Fe-Co Alloy Wire Annealed at 675°F for One Hour Showing Subgrains Which Have Overcome the Pinning by the Particles and are Growing into Other Subgrains.

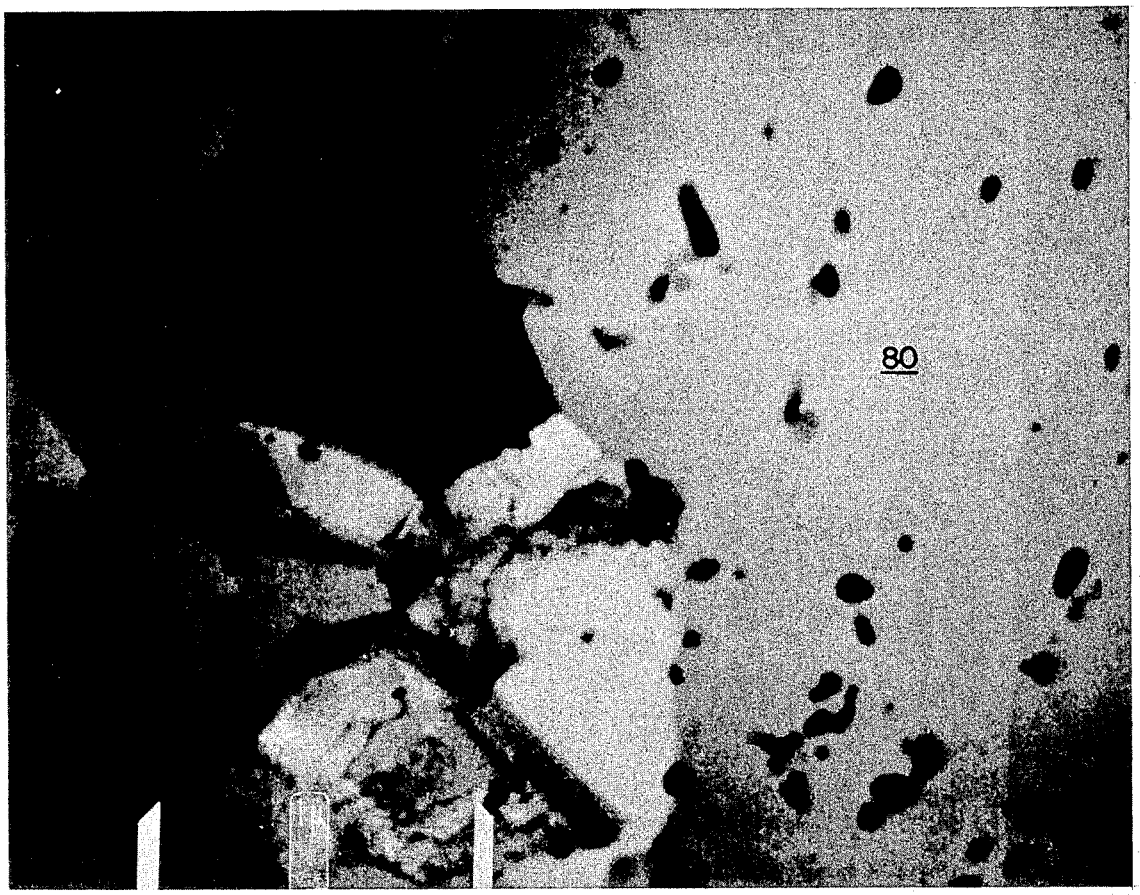
Fig. 26 TEM of the Al-Fe-Co Alloy Wire Annealed at 700°F for One Hour Showing a Large Subgrain Which has Formed at the Onset of Secondary Recrystallization.

METHOD FOR MANUFACTURING AN ALUMINUM ALLOY ELECTRICAL CONDUCTOR

CROSS-REFERENCE TO RELATED APPLICATIONS

This application is a continuation-in-part of copending application Ser. No. 632,982, filed Nov. 18, 1975, now abandoned, which was a continuation-in-part of application Ser. No. 430,300, filed Jan. 2, 1974, now U.S. Pat. No. 3,920,411, which was a continuation of application Ser. No. 199,729, filed Nov. 17, 1971, which in turn was a division of application Ser. No. 54,563, filed July 13, 1970, both now abandoned.

BACKGROUND OF THE INVENTION

This invention relates to a method and apparatus for manufacturing an aluminum alloy wire that is particularly suitable for use in conducting electricity. The wire produced by the method and apparatus of this invention has improved properties of yield strength, ultimate tensile strength, percent ultimate elongation, ductility, fatigue resistance and creep resistance as compared with conventional aluminum alloy electrical conductors of similar electrical properties.

In recent years the use of aluminum as an electrical conductor has increased significantly. An electrical grade conductor with a minimum of 99.45% aluminum was first used for overhead transmission lines in the early 1890's and has been used extensively since then with great success. There are other electrical applications where aluminum could be used only if certain physical and mechanical properties are achieved. These include building wire, telephone cable, battery cable, automotive harness wiring, aircraft cable, transformer wire, magnet wire and appliance cord. Inspection of these uses indicates that a material which possesses high strength and a high degree of connectability, coupled with a minimum loss in electrical conductivity, would be required for successful performance.

Electrical Conductor grade aluminum, in the fully annealed condition, possesses acceptable ductility and electrical conductivity. However, it is seriously handicapped by its poor mechanical properties and thermal stability. This precludes its use in applications where a strong, reliable connection is required. The connection or termination of the system is one of the most critical parts of any electrical system. The termination or connection is also the part that is handled by the public, and consequently is very often subjected to careless or poor workmanship. An ideal system would consist of conductor and termination designed in such a way that it would produce a "fool proof" system.

One of the integral components of the system, the conductor itself, could be made stronger and with high thermal stability simply by alloying the aluminum with magnesium, silicon, copper, etc., as has been done in the past for many structural applications. However, the decrease in electrical conductivity associated with the high solubility of these alloying additions prohibits their use in electrical conductor aluminum in more than very small amounts. Another way that the mechanical properties of the aluminum can be increased is to subject it to a certain amount of cold work in order to produce extensive work hardening in the matrix. This method, however, will render the aluminum unusable as it yields an unstable cold worked structure with both low ductility and extremely low thermal stability.

A method for improving the physical properties of an aluminum alloy without seriously affecting the electrical properties thereof was disclosed in U.S. Pat. No. 3,920,411 of which copending application Ser. No. 632,982, abandoned was a continuation-in-part. The method disclosed therein consisted of alloying from about 0.35 to about 4.0 weight percent cobalt, from about 0.1 to about 2.5 weight percent iron, the remainder being aluminum with associated trace elements, and thereafter continuously casting, hot-working, cold-working without preliminary or intermediate anneals, and thereafter annealing the product to achieve an electrical conductivity about 61% IACS and improved mechanical properties as compared with conventional electrical conductors.

It is an object of this invention to yet further improve the mechanical properties of an aluminum alloy electrical conductor by more closely controlling the thermomechanical processing steps broadly disclosed in the aforementioned U.S. Pat. No. 3,920,411, thereby obtaining a fine, stable cell structure in the aluminum matrix containing a fine dispersion of stable, insoluble intermetallic phase particles.

It has been known for some time that aluminum and its alloys develop a well-defined cell structure when subjected to various degrees of deformation. This is attributed to the high stacking fault energy of aluminum which by the prevention of dislocations splitting into partials, aids in the cross-slip process necessary for subgrain formation. During deformation, the dislocation density increases and well-defined cells are formed until an equilibrium cell size and dislocation density is reached.

Moreover, the prior art has long recognized that the strength of metal is inversely proportional to the size of the grains therein. The effect of grain size on the yield strength of metal was first studied by Hall in 1951 and Petch in 1953 in iron. Their experimental results could be described by a relationship of the type $$\sigma=\sigma_0+k\,d^{-\frac{1}{2}}$$

where $\sigma$ is the yield strength, $\sigma_0$ the frictional stress, and d the grain size. Several investigations have been carried out on the effect of subgrain size on the yield strength of different materials and also found it to obey a Hall-Petch type relation.

Because of the tendency of subgrains to coalesce during recovery and recrystallization, thereby growing in size and thus promoting a decrease in the yield strength of the metal, the prior art recognized that it would be advantageous to provide intermetallic precipitates in the aluminum matrix which could pin dislocation sites between adjacent subgrain boundaries, thereby immobilizing the grain boundaries by hindering the rearrangement of dislocations and therefore inhibiting the movement of the recrystallization front. Accordingly, such precipitates, as discussed in the aforementioned U.S. Pat. No. 3,920,411, could effectively limit the subgrain growth and thus render the physical properties of the metal more stable at elevated temperatures.

As previously mentioned, the conductor of the aforementioned U.S. Pat. No. 3,920,411 is formulated from an aluminum based alloy prepared by mixing cobalt, iron and optionally other alloying elements with aluminum in a furnace to obtain a melt having requisite percentages of elements. The aluminum content of the alloy could vary from about 93.50 percent to about 99.65 percent by weight. The optional alloying element or group of alloying elements could be present in a total concentration of up to 2.50 percent by weight, preferably from 0.1 percent to about 1.75 percent by weight.

After preparing the melt, the aluminum alloy was continuously cast into a continuous bar by a continuous casting machine and then, substantially immediately thereafter, hot-worked in a rolling mill to yield a continuous aluminum alloy rod.

As further described in the aforementioned patent, a continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it is solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which it solidified. In this condition, the cast bar is at a hot-forming temperature within the range of tempertures for hot-forming the cast bar at the initiation of hot-forming without heating between the casting machine and the rolling mill. In the event that it is desired to closely control the hot-forming temperature of the cast bar within the conventional range of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced positions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands function to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectional shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast-aluminum bar.

According to the method described in the aforementioned patent, the continuous rod was cold-drawn through a series of progressively constricted dies, without intermediate anneals, to form a continuous wire of desired diameter. Thereafter, the wire was annealed or partially annealed to obtain a desired tensile strength and cooled. The annealing operation was disclosed as being continuous as in resistance annealing, induction annealing, convection annealing by continuous furnaces or radiation annealing by continuous furnaces, or, preferably, batch annealed in a batch furnace.

In order to produce a product having improved percent ultimate elongation, increased ductuity and fatigue resistance, and increased electrical conductivity in accordance with the objects of the aforementioned patent, it was necessary to anneal at temperatures of about 450° F. to about 1200° F. when continuously annealing with annealing times of about 5 minutes to about 1/10,000 of a minute. On the other hand, when batch annealing, a temperature of approximately 400° F. to about 750° F. was employed with resident times of about 30 minutes to about 24 hours.

Prior art systems for the continuous production of rod from molten metal, i.e., systems where the cast bar is delivered substantially immediately to the rolling mill without an intervening homogenizing step such as described above, typically provide a reduction of less than 30% in the first stand of the rolling mill. Reduction of 20% and 25% are conventional. Upon observation, applicants have found that such a cast bar does not exhibit a clearly defined subgrain structure after that degree of deformation, but rather that the matrix is substantially free of subgrains and that at most there is a randomly disposed arrangement of very large ragged cells.

While a well defined subgrain structure will, of course, be formed during subsequent deformations in prior art systems, the stock product rolled under such conditions is at a disadvantage because the subgrain structure, which becomes broken-up and refined when undergoing subsequent deformations, is deprived of the refining effects of the initial roll stands under which it exhibited an insufficiently-formed subgrain structure. Moreover, a stock product which does not exhibit a well defined subgrain structure after the first deformation undergoes a lesser degree of dynamic recrystallization in the hot-forming process than a stock product in which the subgrain structure is formed after the first deformation. This phenomenon is attributable to the fact that the product is moving at higher speeds and undergoing increased cooling in the latter stages of the rolling mill than in the early stages thereof. Consequently, if the subgrain structure is not sufficiently formed until after the speed and the cooling rate reach critical points, dynamic recrystallization will not take place. Accordingly, the ductility of the stock will be diminished and the finished product will have a lower elongation than a product which undergoes a greater degree of dynamic recrystallization during hot-forming.

It is, therefore, an object of this invention to manufacture an aluminum alloy electrical conductor in a system which includes continuous casting and hot-forming in a series of deformities, and wherein a sufficient degree of deformation is provided in the first of the series of deformations so as to therein form a substantially well-defined subgrain structure in the stock product which will be broken-up and thus refined in subsequent deformations, and which will permit dynamic recrystallization of the product during hot-forming, thereby improving the ductility of the stock.

In accordance with this invention, it has been determined that a reduction of more than 30% in the first roll stand is necessary to achieve the subgrain structure necessary to accomplish the foregoing. In a preferred embodiment of the invention the reduction is at least 37%.

With the above and other objects in view that may become hereinafter apparent, the nature of the invention may be more clearly understood by reference to the attached claims, the following Summary Of The Invention, and the drawings taken in connection therewith, wherein:

FIG. 1 is a schematic diagram of a production process for the aluminum alloy wire of this invention;

FIGS. 2(*a*) and (*b*) are photomicrographs of cast bars which have been rapidly solidified and slowly solidified, respectively;

FIGS. 3(*a*) and (*b*) are photomicrographs taken in the transverse direction through rolled rods which have been manufactured from rapidly solidified and slowly solidified bars, respectively;

FIGS. 4(*a*) and (*b*) are photomicrographs taken in the transverse direction through annealed wire produced from rapidly solidified and slowly solidified bars, respectively;

FIG. 5 is a photomicrograph of a cast bar, formulated in accordance with this invention, in the as-cast condition, and illustrates colonies of (Fe, Co) $Al_9$ and $FeAl_6$ eutectic in the aluminum matrix;

FIGS. 6 and 7 are photomicrographs showing the onset of subgrain formation between rows of eutectic after the first pass in the rolling mill;

FIG. 8 is a photomicrograph showing dislocations forming cells in the vicinity of precipitates after the first pass;

FIG. 9 is a photomicrograph showing the subgrain structure after the second pass (59.2% reduction);

FIG. 10 is a photomicrograph showing the subgrain structure after the third pass (69.2% reduction);

FIG. 11 is a photomicrograph after the fourth pass (78.1% reduction);

FIG. 12 is a photomicrograph showing the subgrain structure after the sixth pass (88.4% reduction);

FIG. 13 is a photomicrograph showing the subgrain structure after the seventh pass (91.3% reduction), and illustrates an increase in the dislocation density within the cells due to a decrease in dynamic recovery at this stage;

FIG. 14 is a photomicrograph showing the subgrain structure after the eighth pass (94.0% reduction);

FIG. 15 is a photomicrograph after the ninth pass (99.5% reduction);

FIG. 16 is a photomicrograph after the tenth pass (96.8% reduction);

FIG. 17 is a photomicrograph after the eleventh pass (97.7% reduction);

FIG. 18 is a photomicrograph after the twelfth pass (98.2% reduction);

FIG. 19 is a plot of average subgrain size v. total percent reduction in area;

FIG. 20 is a plot of electrical conductivity v. annealing temperature for a wire product manufactured in accordance with this invention;

FIG. 21 is a plot of tensile strength v. annealing temperature for a wire product manufactured in accordance with this invention;

FIG. 22 is a plot of subgrain size v. annealing temperature for a wire product manufactured in accordance with this invention;

FIG. 23 is a photomicrograph of the Al-Fe-Co alloy wire annealed at 475° F., and illustrates a growing recrystallization nucleus;

FIG. 24 is a photomicrograph of the Al-Fe-Co alloy wire isochronally annealed at 500° F. for one hour, and illustrates the inter particle spacing becoming of the same magnitude as the subgrain size;

FIG. 25 is a photomicrograph of the wire annealed at 675° F. for one hour, and shows the subgrains overcoming the pinning effect of the particles; and FIG. 26 is a photomicrograph of the wire annealed at 700° F., and illustrates large subgrains forming at the onset of secondary recrystallization.

SUMMARY OF THE INVENTION

Figure 2A:
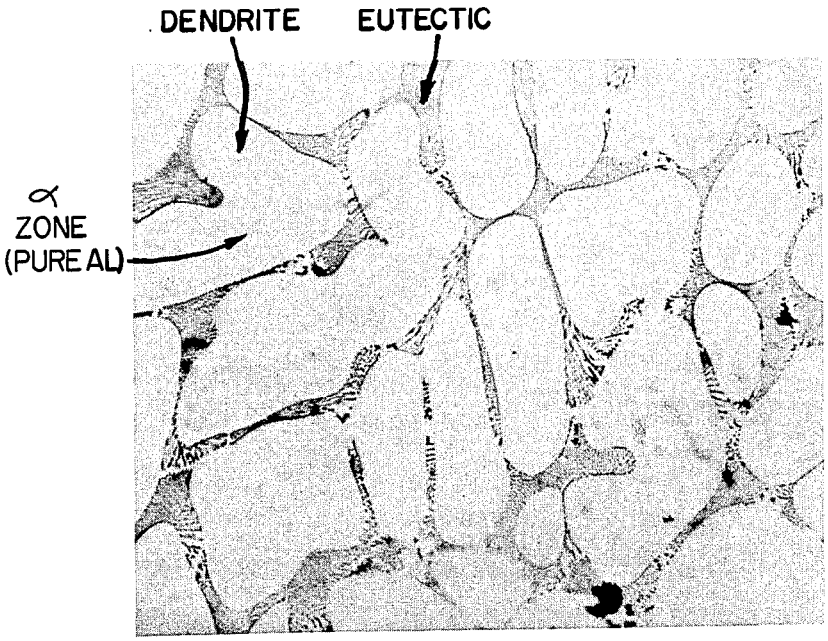

It has now been found, in accordance with this invention, that the subgrain structure of an aluminum alloy electrical conductor can be improved by more closely controlling the thermomechanical processing, particularly the casting rate, deformation parameters and annealing characteristics. In the exemplary embodiment of the invention described hereinafter, this processing was performed using an Al-Fe-Co alloy formulated in accordance with the following example. In general, however, the aluminum may be alloyed with any element or elements that will yield intermetallic precipitates and that will not decrease the electrical conductivity below 58 IACS. Such additional alloying elements include the following:

| ADDITIONAL ALLOYING ELEMENTS | | |
|---|---|---|
| Magnesium | Yttrium | Teribium |
| Cobalt | Scandium | Erbium |

-continued

| ADDITIONAL ALLOYING ELEMENTS | | |
|---|---|---|
| Iron | Thorium | Neodymium |
| Nickel | Tin | Indium |
| Copper | Molybdenum | Boron |
| Silicon | Zinc | Thallium |
| Zirconium | Tungsten | Rubidium |
| Cerium | Chromium | Titanium |
| Niobium | Bismuth | Carbon |
| Hafnium | Antimony | |
| Lanthanum | Vanadium | |
| Tantalum | Rhenium | |
| Cesium | Dysprosium | |

EXAMPLE

Aluminum ingots with the chemical composition in Table 1 were melted in a reverberatory furnace. The metal was heated to 1350° F. prior to adding UCAR alloy #1 briquettes containing 41% cobalt-35% iron and 24% aluminum to make a 0.5 weight percent cobalt 0.5 weight percent iron alloy. The alloy briquettes addition was made in the launder between the melter and holding furnaces during the transfer of the metal. The necessary amount of briquettes was placed in the trough, with a dam at the lower end to prevent the briquettes from being washed into the holding furnace without first being taken into solution with the aluminum. The metal was stirred after alloying in order to facilitate the homogenization of the alloy. After a 30-minute period, the alloy was sampled through two doors located on opposite sides of the furnace. The metal temperature in the holding furnace was 1350° F.±10° F. which resulted in a crucible temperature of 1290° F.±10° F.

TABLE 1

CHEMICAL COMPOSITION OF ALUMINUM INGOTS (Weight Percent)

| Fe | Si | Cu | Mn | Mg | Cr | Ni | Zn |
|---|---|---|---|---|---|---|---|
| 0.15 | 0.04 | 0.001 | 0.003 | 0.008 | 0.001 | 0.001 | 0.02 |

| Ti | V | Ga | B | Na | Al |
|---|---|---|---|---|---|
| 0.001 | 0.005 | 0.006 | 0.001 | 0.001 | Balance |

It is to be understood that while this invention is described herein in connection with the specific Al-Fe-Co alloy described above, the scope of the invention is intended to cover all aluminum alloys that similarly behave under the same thermomechanical processing steps disclosed herein. Accordingly, it has been found that suitable results are obtained with cobalt being present in a weight percentage of about 0.2 to about 4.0, and iron present in a weight percentage of from about 0.2 to about 2.5. Superior results are achieved when cobalt is present in a weight percentage of from about 0.35 to about 2.0, and iron is present in a weight percentage of from about 0.3 to about 1.5. Particularly superior and preferred results are obtained when cobalt is present in a weight percentage of from about 0.4 to about 0.95, and iron is present in a weight percentage of from about 0.4 to about 0.95.

The aluminum content of the present alloy may vary from about 93.50 percent to about 99.6 percent. If commercial aluminum is employed in preparing the present melt, it is preferred that the aluminum, prior to adding to the melt in the furnace, contain no more than 0.1 percent total of trace impurities.

Optionally, the present alloy may contain an additional alloying element or group of alloying elements. The total concentration of the optional alloying elements may be up to 2.50 percent by weight; preferably from about 0.1 percent to about 1.75 percent by weight is employed. Particularly superior and preferred results are obtained when 0.1 percent to about 1.5 percent by weight of total additional alloying elements is employed.

1. Casting Rate

It has been determined in accordance with this invention that in order to produce a final wire product with small, uniformly distributed precipitate particles which will serve to limit subgrain growth and pin dislocation sites between subgrain boundaries, thereby producing a more stable product with improved properties, rapid solidification producing a small interdendritic spacing is necessary. To this end, the molten metal is preferably cast in a wheel-band type continuous casting machine generally designated by the numeral 20 in FIG. 1.

The casting machine 20 includes a steel mold and is provided with sufficient coolant capacity to cool the molten metal at a rate of at least 311° F./min.

Figure 2B:
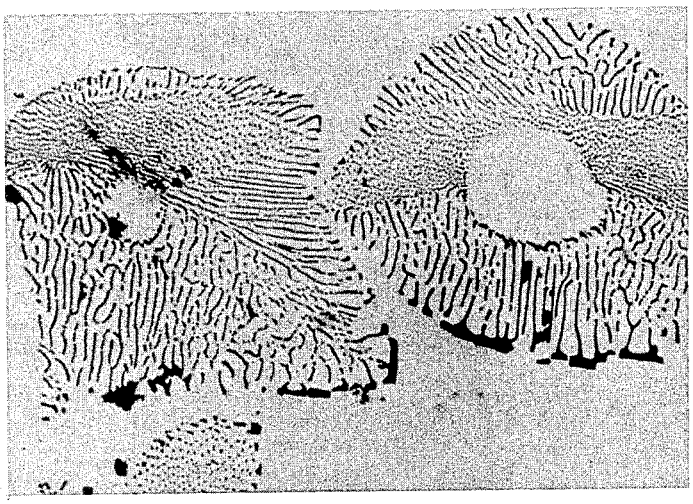

The rapidly solidified cast bar exhibits well developed pure aluminum dendrites with a network of interdendritic eutectic as seen in FIG. 2(*a*). The eutectic consists of an aluminum matrix and Al-Fe-Co compounds. The nature of the compounds are, of course, determined by the nature and percentage of alloying elements alloyed with the aluminum. In an alloy formulated with 0.5 Fe and 0.5 Co according to the above EXAMPLE, the intermetallic compounds will be of the type $FeAl_3$, $FeAl_6$, $CoAl_9$ and $(FeCo)_2Al_9$. As will be discussed more fully hereinafter, the eutectic compounds will be broken up and distributed throughout the aluminum matrix during hot deformation and cold-drawing, which results in a further reduction of the inter particle spacing. The precipitates act as barriers to the dislocation motion, thereby inhibiting subgrain growth and limiting the cell size in the finished wire, thus producing excellent mechanical and electrical properties therein.

The fine eutectic network of the rapidly solidified bar as seen in FIG. 2(*a*) can be compared to the as-cast structure of a bar slowly solidified at a rate of 28° F./min as seen in FIG. 2(*b*). The latter structure shows patches or colonies of eutectic compound distributed in a matrix of primary aluminum.

Figure 3A:
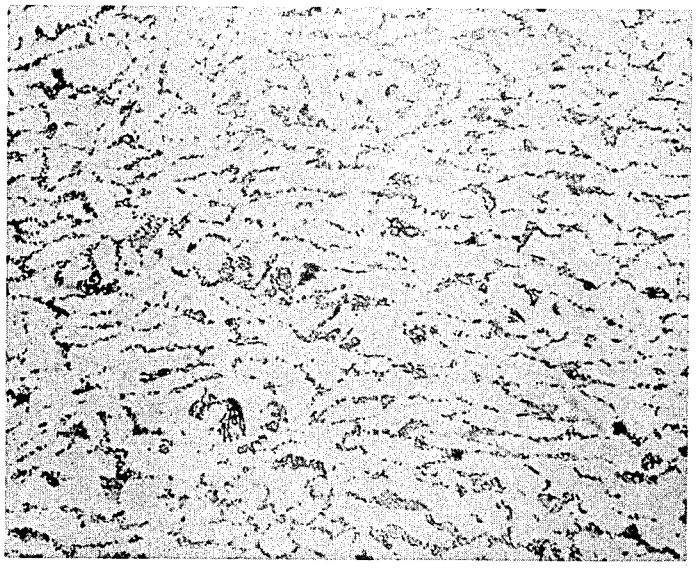
Figure 3B:
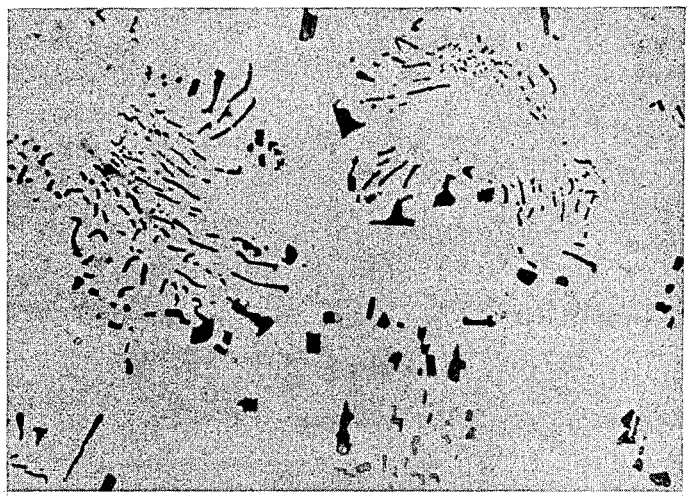
Figure 4A:
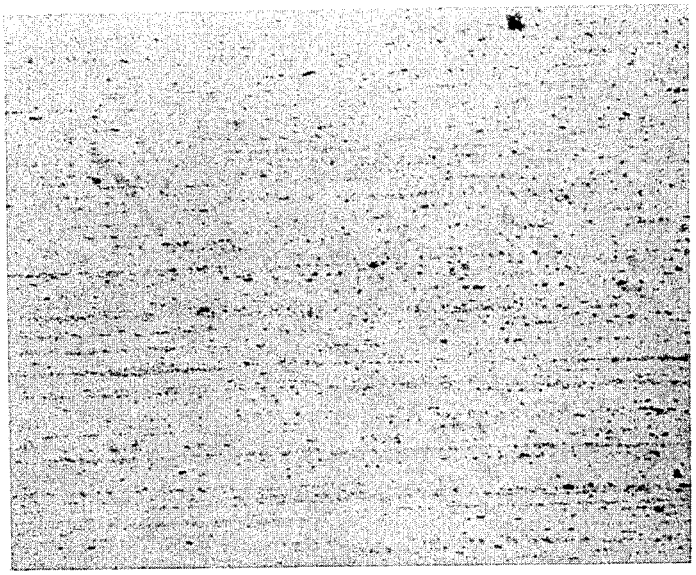
Figure 4B:
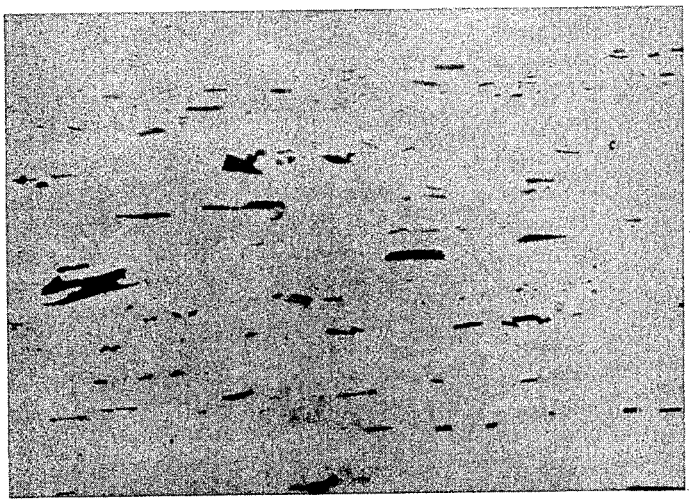

The fine eutectic networks formed during rapid solidification can be traced through the hot-rolled rod as seen in FIG. 3(*a*) to the finished wire product as seen in FIG. 4(*a*). On the other hand, the absence of a uniform eutectic network in the as-cast structure of the slowly solidified bar can be observed also in rod hot-rolled therefrom as seen in FIG. 3(*b*) as well as in its finished wire product as seen in FIG. 4(*b*).

The non-uniform distribution of precipitates in products manufactured from the slowly-solidified bar results from the slow solidification which causes all of the cobalt and iron to precipitate as large particles in non-uniformly distributed eutectic colonies. The large areas devoid of precipitates cannot resist the movement of the grain boundaries and therefore subgrain coalescence takes place during annealing. Accordingly, such a product will have inferior properties as compared with the rapidly solidified product.

In view of the foregoing, it should be apparent that rapid solidification, such as is obtained with continuous casting, results in a reduction of the inter-particle spacing in the eutectic, as compared with the greater spacing resulting from slower modification, thereby yielding a finer subgrain structure. Moreover, it has been further determined in accordance with this invention that if the frequency of nuclei formation can be increased during solidification, such as by increasing the degree of supercooling or by introducing vibrational energy into the mold, the dendritic arm spacing can be further reduced. Consequently, the eutectic spacing will be decreased and thus the extent of subgrain growth during annealing will be limited by the closely spaced precipitate particles that become broken up from the eutectic during subsequent rolling and drawing.

2. Deformation Parameters

As seen in FIG. 1, after the cast bar exits from the continuous casting machine 20 it is conveyed substantially immediately, in the as-cast condition, into a rolling mill 30. The cast bar enters the rolling mill 30 having a cross-sectional area of 8.24 square inches and it is deformed therein in a series of deformations to a 0.375 inch diameter rod. The bar enters the rolling mill 30 at a temperature of 1050° F. and exits therefrom at a temperature of 750° F. The various rolling parameters in each roll stand are presented in Table 2.

TABLE 2

Rolling Speed Per Pass During Hot Deformation

| Hot Rolling (pass no.) | Area (sq. inches) | Total Reduction of area (percent) | Speed of Each Roll (Feet/Minute |
|---|---|---|---|
| As-Cast | 8.240 | 0 | 28 |
| 1 | 5.150 | 37.3 | 45 |
| 2 | 3.342 | 59.2 | 69 |
| 3 | 2.523 | 69.2 | 91 |
| 4 | 1.794 | 78.1 | 129 |
| 5 | 1.410 | 82.8 | 164 |
| 6 | 0.953 | 88.4 | 242 |
| 7 | 0.712 | 91.3 | 324 |
| 8 | 0.493 | 94.0 | 468 |
| 9 | 0.372 | 95.5 | 620 |
| 10 | 0.263 | 96.8 | 877 |
| 11 | 0.192 | 97.7 | 1202 |
| 12 | 0.148 | 98.2 | 1559 |
| 13 | 0.116 | 98.6 | 1989 |

As discussed above, the hot-forming of the bar into rod in the rolling mill 30 will convert the aluminum matrix into a fine subgrain structure by increasing the dislocation density which facilitates the cross-slip process necessary for subgrain formation. Once the subgrain structure is formed, the subsequent deformations will break up the subgrains thereby refining the same, as well as break up the eutectic compounds and distribute them throughout the aluminum matrix.

As seen in FIG. 5, which is a micrograph of the Al-Fe-Co bar in the as-cast condition, the as-cast bar exhibits a complete absence of subgrains in the matrix. The eutectic compound 40 is grouped in colonies which have precipitated during casting, and there is a negligible dislocation density throughout the matrix. However, after the initial reduction in cross-section of 37.3% which occurs in the first roll stand 50 of the rolling mill 30, a well defined subgrain structure begins to form between rows of precipitates as can be seen at 60 in FIG. 6. The formation of this structure is further illustrated in FIG. 7. The rows of precipitates 40 act as dislocation sources during deformation and as initial barriers to the motion of dislocations, causing pile-ups and subsequent subgrain formation. At this stage, the areas of the matrix devoid of precipitates do not show significant subgrain formation. There are, however, dislocations randomly dispersed in the matrix and associated with the beginning of subgrain formation as seen in FIG. 8.

The effect of subsequent deformations in the remaining roll stands of the mill 30 can be seen by comparing FIGS. 9–18. As seen in FIG. 9, after a reduction of 59.2% the bar exhibits a slightly high degree of subgrain formation and a higher concentration of dispersed dislocations which in some areas appear aligned in a position to form subgrain boundaries.

The average subgrain size after 59.2 total reduction by hot-working is 5.0 microns. After a total reduction of 69.2% during hot-rolling, the substructure becomes significantly smaller, having an average cell size of 2.9 microns and becomes uniform throughout the matrix, even in areas devoid of precipitates as seen in FIG. 10. The material possesses an average cell size of 2.5 microns after 78.1% reduction as seen in FIG. 11 showing a good cell uniformity throughout. As seen in FIGS. 12–18, as the reduction in area increases, the cell size and distribution decreases continuously up to a total reduction of 98.6%.

From FIG. 19, which is a plot of the cell size v. the hot-rolling reduction sequence, it can be observed that the cell size decreases progressively until the 9th pass (95.5% area reduction), and that thereafter there is no further decrease in cell size.

As discussed above, it has been determined in accordance with this invention that it is necessary to provide a sufficient degree of deformation in the first roll stand 50 so as to form a substantially well-defined subgrain structure in the stock product which will be broken up and thus refined in subsequent deformations, and which will permit dynamic recrystallization of the product during hot-forming, thereby improving the ductility of the product. In accordance with this invention, it has been determined that a reduction of more than 30% in the first roll stand is necessary to achieve the subgrain structure necessary to accomplish the foregoing. In the preferred embodiment of the invention the reduction is at least approximately 37%.

After hot-working, the rod may be cold-worked by drawing through a series of wire-drawing dies as designated generally by the numeral 70 in FIG. 1. The 0.375 inch diameter rod entering the drawing dies 70 is drawn down into 0.105 inch diameter wire without any preliminary or intermediate anneals.

3. Annealing Characteristics

Annealing the hot-rolled rod before cold-drawing has a detrimental effect on the mechanical properties of the finished wire due to the excessive growth of the subgrains before cold-work and to the precipitation of the compounds before the final anneal. However, by cold-working without any preliminary or intermediate anneals as described above, the precipitate particles will be uniformly dispersed throughout the aluminum matrix thus acting as barriers to the movement of the subgrain boundaries during subsequent annealing.

Annealing after cold-working will dramatically improve the elongation characteristics of the wire as well as the electrical conductivity thereof. As seen in FIG. 20, which is a plot of electrical conductivity v. annealing temperature, the electrical conductivity increases rapidly with annealing temperatures above 300° F. and begins to level off at annealing temperatures above 530° F. However, as seen in FIG. 21, which is a plot of tensile strength v. annealing temperature, it can be seen that both the ultimate tensile strength and yield strength decrease substantially when the wire is annealed at temperatures above 300° F.

As seen in FIG. 22, which is a plot of subgrain size v. annealing temperature, primary recrystallization starts at about 475° F. in the cold-rolled Al-0.5% Fe-0.5% Co alloy wire produced from the rapidly solidified bar. The onset of recrystallization is marked by the coalescence of certain subgrains to form the recrystallization nucleus. This is illustrated in FIG. 23. The nucleus grows to form a high-angle boundary grain structure with thin, delineated grain walls. During recrystallization subgrain growth is inhibited by the presence of the precipitate particles which have been formed and uniformly distributed according to the thermo-mechanical processing steps disclosed hereinabove, and which act as pinning points to the movement of the subgrain boundaries. This can be seen most clearly in FIG. 24. Thus, the resulting average size of the recrystallized subgrains in the annealed wire is of the same magnitude as the average inter particle spacing.

As further seen in FIG. 22, secondary recrystallization will take place at 700° F. when the pinning effect of the precipitates is overcome by the introduced energy. In FIG. 25 it can be seen that certain subgrains have overcome the pinning effect of the particles and have grown into other subgrains. In FIG. 26 there is illustrated a large subgrain 80 which has formed at the onset of the secondary recrystallization at 700° F. It should be apparent, therefore, that the wire manufactured in accordance with this invention should not be annealed above 700° F., whereupon the average subgrain size will be less than 0.9 microns, thereby promoting the improved physical properties described above.

In view of the foregoing, it should be apparent that there is provided in accordance with this invention a novel method and apparatus for manufacturing an aluminum alloy conductor whereupon the thermomechanical processing steps may be closely controlled so as to obtain a fine subgrain structure which will materially improve the physical properties of the conductor as compared with electrical conductors manufactured in accordance with conventional techniques. Essentially, the wire must be manufactured from an aluminum alloy having a sufficient proportion of alloying elements added thereto which will yield intermetallic precipitates during subsequent thermomechanical processing. The melt must be rapidly cast in order to form an interdendritic structure having a short arm spacing as well as close inter particle spacing. Thereafter, the cast bar must be hot-worked, in the as-cast condition, in a series of deformations which includes the steps of increasing the dislocation density in the matrix during the first of the series of deformations sufficiently to form a substantially well-defined subgrain structure therein, thereby maximizing a refinement of the subgrain structure by permitting breaking-up thereof in each of the subsequent deformations.

The hot-rolled product must then be cold-worked, without any preliminary or intermediate anneals, to further break up and disperse the particles throughout the aluminum matrix. The cold-worked wire is then annealed to improve the elongation and electrical conductivity thereof. The wire must not be annealed above a temperature at which subgrain coalescence takes place. For the alloys specifically disclosed herein, the annealing should take place below a temperature of 700° F., and preferably between 475° F. and 700° F.

Although only preferred embodiments of the invention have been specifically described herein, it is to be understood that minor modifications could be made therein without departing from the spirit and scope of the invention as defined in the appended claims.

We claim:

1. Method of manufacturing an aluminum alloy electrical conductor having a minimum conductivity of 58% IACS, a minimum yield strength of 12,000 PSI, and a minimum ultimate tensile strength of 18,000 PSI, comprising:

(a) alloying a minimum of 93.5% by weight molten aluminum, having normal trace impurities associated therewith, with from about 0.4 to about 6.5 percent by weight total at least one additional alloying element selected from the group consisting essentially of cobalt, iron and other elements capable of yielding intermetallic precipitates during subsequent thermomechanical processing without reducing the conductivity of the conductor below said 58% IACS;

(b) rapidly casting the melt into a bar having an as-cast structure of pure aluminum dendrites with an interdendritic eutectic network consisting of an aluminum matrix and intermetallic precipitates of aluminum and said at least one alloying element;

(c) hot-working said cast bar, in the as-cast condition, into rod in a series of deformations to reduce the cross-sectional area thereof and convert the aluminum matrix into a fine subgrain structure; and (d) wherein said step of hot-working includes increasing the dislocation density in the matrix during the first of said series of deformations sufficiently to form a substantially well-defined subgrain structure therein, thereby maximizing a refinement of said subgrain structure by permitting breaking-up thereof in each of the subsequent deformations.

2. The method of manufacturing an aluminum alloy electrical conductor as defined in claim 1, wherein said step of sufficiently increasing the dislocation density includes reducing the cross-sectional area of the bar by more than 30% in the first deformation.

3. The method of manufacturing an aluminum alloy electrical conductor as defined in claim 2, wherein said reduction is at least 37%.

4. The method of manufacturing an aluminum alloy electrical conductor as defined in claim 1, further including the steps of:

(e) cold-working the rod into wire by reducing its cross-sectional area in a series of further deformations, without any preliminary anneals or intermediate anneals between each of said series of further deformations, to thereby further break-up and refine the subgrain structure as well as break-up and distribute said intermetallic precipitates throughout the aluminum matrix; and (f) thereafter annealing said wire at a temperature less than the temperature at which the matrix no longer exhibits a substantially refined and uniform subgrain structure.

5. The method of manufacturing an aluminum alloy electrical conductor as defined in claim 4, wherein said annealing step is performed at less than approximately 700° F.

6. The method of manufacturing an aluminum alloy electrical conductor as defined in claim 4, wherein said annealing step is performed in the range of from about 475° F. to about 700° F.

7. The method of manufacturing an aluminum alloy electrical conductor as defined in claim 1, wherein said step of rapidly casting is performed in a wheel-band type continuous casting machine, said step of hot-working is performed in a rolling mill having a plurality of roll stands positioned therein, said cast bar being substantially immediately conveyed from said continuous casting machine into said rolling mill, and further including the steps of:

(e) drawing the rod through a series of wire-drawing dies, without any preliminary or intermediate anneals, to form wire, and thereafter (f) annealing or partially annealing the wire.

8. The method of claim 1 wherein said additional alloying elements are iron and cobalt, and said intermetallic precipitates are of the phase $FeAl_3$, $Co_2Al_9$ and $(CoFe)_2Al_9$.

9. The method of claim 8 wherein cobalt is present in a weight percent of from about 0.2 to about 4.0 and iron is present in a weight percent of from about 0.2 to about 2.5.

10. The method of claim 8 wherein cobalt is present in a weight percent of from about 0.35 to about 2.0 and iron is present in a weight percent of from about 0.3 to about 1.5.

11. The method of claim 8 wherein cobalt is present in a weight percent of from about 0.4 to about 0.95 and iron is present in a weight percent of from about 0.4 to about 0.95.

12. The method of claim 11, wherein said step of sufficiently increasing the dislocation density includes reducing the cross-sectional area of the bar by an amount which initiates the formation of subgrains having an average size of less than 5.5 microns.

13. The method of claim 11, further including cold-working the rod into wire, and thereafter annealing the wire at a temperature less than the temperature at which the subgrains will grow to a size exceeding 0.9 microns.

* * * * *